US009383089B2

(12) United States Patent
Yang

(10) Patent No.: US 9,383,089 B2
(45) **Date of Patent: *Jul. 5, 2016**

(54) HEAT RADIATION DEVICE FOR A LIGHTING DEVICE

(71) Applicant: Hongwu Yang, Dalian (CN)

(72) Inventor: Hongwu Yang, Dalian (CN)

( * ) Notice: Subject to any disclaimer, the term of this patent is extended or adjusted under 35 U.S.C. 154(b) by 437 days.

This patent is subject to a terminal disclaimer.

(21) Appl. No.: 13/909,776

(22) Filed: Jun. 4, 2013

(65) Prior Publication Data

US 2013/0265781 A1 Oct. 10, 2013

Related U.S. Application Data

(63) Continuation-in-part of application No. 12/410,398, filed on Mar. 24, 2009, now Pat. No. 8,562,178.

(30) Foreign Application Priority Data

Jun. 24, 2008 (CN) ..... 2008 1 0115474
Nov. 13, 2008 (CN) ..... 2008 1 0176467

(51) Int. Cl.
*F28F 7/00* (2006.01)
*F21V 29/00* (2015.01)
(Continued)

(52) U.S. Cl.
CPC ..... *F21V 29/2206* (2013.01); *F21V 29/006* (2013.01); *F21V 29/74* (2015.01);
(Continued)

(58) Field of Classification Search
CPC ..... F21V 29/51; F21V 29/006; F21V 29/70; F21V 29/02; F21V 29/71; F21V 29/13; F21V 29/74
USPC ..... 362/294, 373, 547, 218, 345, 264; 165/185, 80.3, 104.33
See application file for complete search history.

(56) References Cited

U.S. PATENT DOCUMENTS 3,226,602 A 12/1965 Elfving ..... 317/100
4,588,023 A 5/1986 Munekawa ..... 165/104.33
(Continued)

FOREIGN PATENT DOCUMENTS

AU 2009201492 B2 4/2009
CN 2598139 Y 1/2004
(Continued)

OTHER PUBLICATIONS

Chinese First Examination Report of corresponding China Application No. 200810176467.6, dated Jan. 8, 2010.
(Continued)

*Primary Examiner* — Evan Dzierzynski
*Assistant Examiner* — Leah S Macchiarolo
(74) *Attorney, Agent, or Firm* — J.C. Patents

(57) ABSTRACT

The present invention relates to a heat radiation device of lighting device. The heat radiation device of lighting device comprises passive heat radiator and mounting assembly, the passive heat radiator includes: a heat radiating base plate; a slablike upstanding plate, the slablike upstanding plate is a solid plate of metal material; a heat absorbing ending face disposed at one side of the heat radiating base plate deviated from the upstanding plate, and adapted to mount luminous chip of the lighting device; heat radiating fins connected to a surface of the slablike upstanding plate, the heat radiating fins are of hollow cubic tubular structure; the heat radiating base plate of the passive heat radiator is connected with the mounting assembly. The present invention adopts upstanding plate which substantially perpendicular with the horizontal plane and heat radiating fins of hollow cubic tubular structure, improves heat radiating effect.

18 Claims, 20 Drawing Sheets

(51) Int. Cl.

| | |
|---|---|
| ***F28F 3/02*** | (2006.01) |
| ***F28D 15/02*** | (2006.01) |
| ***F28F 1/14*** | (2006.01) |
| ***F21V 29/74*** | (2015.01) |
| ***F21V 29/76*** | (2015.01) |
| *F21W 131/103* | (2006.01) |
| *F21W 131/109* | (2006.01) |
| *F21Y 101/02* | (2006.01) |
| *F28D 21/00* | (2006.01) |
| *F21V 31/00* | (2006.01) |
| *F21V 23/02* | (2006.01) |
| *F21Y 105/00* | (2016.01) |

(52) U.S. Cl.

CPC ..... *F21V 29/76* (2015.01); *F28D 15/0233* (2013.01); *F28F 1/14* (2013.01); *F28F 3/02* (2013.01); *F21V 23/02* (2013.01); *F21V 31/005* (2013.01); *F21W 2131/103* (2013.01); *F21W 2131/109* (2013.01); *F21Y 2101/02* (2013.01); *F21Y 2105/001* (2013.01); *F28D 2021/0029* (2013.01); *F28F 2275/04* (2013.01); *F28F 2275/14* (2013.01)

(56) References Cited

U.S. PATENT DOCUMENTS

| | | | | |
|---|---|---|---|---|
| 5,076,351 | A | 12/1991 | Munekawa et al. | 165/104.21 |
| 7,650,931 | B2 | 1/2010 | Siu | 165/104.26 |
| 2003/0056942 | A1 | 3/2003 | Ota et al. | 165/104.33 |
| 2005/0061486 | A1 | 3/2005 | Yang | 165/104.33 |
| 2005/0257914 | A1 | 11/2005 | Huang | 165/80.3 |
| 2006/0021734 | A1 | 2/2006 | Chang et al. | 165/80.3 |
| 2006/0250800 | A1 | 11/2006 | Chang et al. | 362/294 |
| 2007/0053939 | A1 | 3/2007 | Yokoyama et al. | 424/400 |
| 2007/0230184 | A1 | 10/2007 | Shuy | 362/294 |
| 2007/0285926 | A1 | 12/2007 | Maxik | 362/294 |
| 2008/0007954 | A1 | 1/2008 | Li | 362/294 |
| 2008/0043479 | A1 | 2/2008 | Wang | 362/373 |
| 2008/0080189 | A1 | 4/2008 | Wang | 362/294 |
| 2008/0089070 | A1 | 4/2008 | Wang | 362/294 |
| 2009/0015125 | A1* | 1/2009 | Shuy | F21K 9/00 313/46 |

FOREIGN PATENT DOCUMENTS

| | | | |
|---|---|---|---|
| CN | 1481208 | A | 3/2004 |
| CN | 2720630 | Y | 8/2005 |
| CN | 2763970 | Y | 3/2006 |
| CN | 200955716 | Y | 10/2007 |
| CN | 200997741 | Y | 12/2007 |
| CN | 101430083 | B | 12/2011 |
| DE | 20 2008 003 496 | U1 | 6/2008 |
| EP | 0 409 179 | A1 | 1/1991 |
| EP | 1 760 393 | A1 | 3/2007 |
| EP | 2 138 794 | B1 | 12/2009 |
| JP | 54-039979 | U | 3/1979 |
| JP | 56-133591 | A | 10/1981 |
| JP | 2002-244748 | A | 8/2002 |
| JP | 2002-364990 | | 12/2002 |
| JP | 2003-051697 | A | 2/2003 |
| JP | 2004-156835 | A | 6/2004 |
| JP | 2005-093097 | A | 4/2005 |
| JP | 2008-135359 | A | 6/2006 |
| JP | U3126628 | B | 10/2006 |
| JP | 2008-200134 | A | 9/2008 |
| JP | 2011-063862 | A | 3/2011 |
| JP | P4937299 | B2 | 3/2012 |
| KR | 10-0820080 | B1 | 4/2008 |
| KR | 10-1128193 | B1 | 3/2012 |
| MY | 147523 | A | 12/2012 |
| WO | WO2007053939 | A1 | 5/2007 |

OTHER PUBLICATIONS

Chinese Second Examination Report of corresponding China Application No. 200810176467.6, dated Sep. 1, 2010.

Chinese Third Examination Report of corresponding China Application No. 200810176467.6, dated May 3, 2011.

Chinese Granted Patent Publication No. 101430083B of corresponding China Application No. 200810176467.6, published on Dec. 21, 2011.

The extended European Search Report of corresponding European application No. 0900591.4 dated Aug. 6, 2009.

Australian Examination Report of corresponding Australia application No. 2009201492, dated Jul. 20, 2010.

Japanese Examination Report of corresponding Japan application No. 2009-133765, dated Oct. 4, 2011.

Korean First Examination Report of corresponding Korea application No. 10-2009-0055900, dated Mar. 4, 2011.

Korean Second Examination Report of corresponding Korea application No. 10-2009-0055900, dated Aug. 30, 2011.

Malaysian Examination Report of corresponding Malaysia application No. P120091440, dated Aug. 15, 2011.

* cited by examiner

HEAT RADIATION DEVICE FOR A LIGHTING DEVICE

CROSS-REFERENCE TO RELATED APPLICATIONS

This application is a continuation-in-part application of U.S. patent application Ser. No. 12/410,398, filed on Mar. 24, 2009, entitled "PASSIVE HEAT RADIATOR AND STREETLIGHT HEAT RADIATING DEVICE", now allowed, which claims priority to Chinese Patent Applications No. 200810115474.5, filed on Jun. 24, 2008 and No. 200810176467.6 filed on Nov. 13, 2008, entitled "PASSIVE HEAT RADIATOR AND STREETLIGHT HEAT RADIATING DEVICE". The afore-mentioned patent applications are hereby incorporated by reference in their entireties.

FIELD OF THE INVENTION

The present invention relates to heat radiating technology, particularly to a passive heat radiation device for a lighting device.

BACKGROUND

Due to heavy consumption of electrical energy, a wide range of electrical equipment has heat radiating problem to a certain extent, for example, common high-power light emitting diode (LED) streetlights. The p-n junction temperature of a LED generally is not allowed to exceed a limit of 85° C. When the p-n junction temperature of a LED exceeds 85° C., the life of the LED will correspondingly reduce 50% with every 5° C. increase in the p-n junction temperature and brightness of the LED streetlight will decay 50% per half year. Therefore, the streetlight heat radiating problem, i.e., how to transfer the heat generated by the p-n junction of a LED to environment, has become a key issue in extending life expectancy and delaying brightness attenuation of a LED streetlight.

In prior art, a commonly adopted LED streetlight heat radiating structure is a die-casting or extruded aluminum alloy heat radiator. As shown in FIG. 1, LED bulbs 1 are mounted on bulb holders 2; an aluminum-alloy heat radiating base plate 3 is connected with the bulb holders 2 of the LED bulbs 1 by die casting; heat radiating fins 4 are perpendicularly connected on the heat radiating base plate 3. Normally, the heat radiating fins 4 are set to be extending outwards. In the process of implementing heat radiating, relying on metal thermal conductivity, heat generated by the LED bulbs 1 is transmitted via the bulb holders 2, the heat radiating base plate 3 and the heat radiating fins 4, and finally spread to the air. However, the aluminum alloy heat radiating structure has following defects: thermal conductivity coefficient of aluminum alloy is 100 W/MK; temperature decreases quickly along the distance of heat transmission; although this kind of heat radiator can be prepared with large superficial area, due to big thermal resistance of inner thermal conductivity, the heat radiator has a very small actually effective heat radiating area, which results in poor heat radiating effect.

Another LED streetlight heat radiating structure in prior art adopts a loop wick (LHP) heat radiator. LHP is a typical linear heat conduction element. The heat radiating principle is shown in FIG. 2. Heat radiating working substance is filled into a heat radiating loop tube 100, contacts with the heat generating area of the electronic element at an evaporating end 110, absorbs heat, and is evaporated from liquid working substance into gaseous state. After that, the heat radiating working substance flows from the evaporating end 110 of the heat radiating loop tube 100 to the condensing end 130 under the action of the wick 120. During this process, the heat is transmitted to a bigger heat radiating surface and the heat radiating working substance is transformed from gaseous state back to liquid state and returns to the evaporating end 110. When a LHP heat radiator is used as the LED streetlight heat radiating structure, the heat radiating loop tube is commonly disposed outside a lamp cap and the evaporating end of the heat radiating loop tube is usually arranged at a heat source which is usually at the top of the lamp cap. However, this kind of LHP heat radiating means also has the following problem: the heat radiating loop tube has small contacting area with the heat radiating area and the contacting thermal resistance is large, as a result, a large effectively extended heat radiating area can not be acquired and the heat radiating effect is undesirable.

SUMMARY

The main subject of the present invention is to provide a heat radiation device for a lighting device so as to improve heat radiating efficiency for the lighting device.

In order to accomplish the above subject, the present invention provides a heat radiator for a lighting device, comprising a passive heat radiator and a mounting assembly, wherein:

the passive heat radiator comprises: a heat radiating base plate provided with a heat absorbing ending face, a housing connected to the heat radiating base plate, and heat radiating fins connected to the housing, wherein the heat absorbing ending face is disposed at one side of the heat radiating base plate deviated from the housing, and adapted to mount a luminous chip of the lighting device;

the housing comprises:

a slablike upstanding plate, defining a cavity and connected to the heat radiating base plate, wherein the cavity is under vacuum and is filled with liquid working substance having heat evaporation characteristics;

a wick, disposed in the cavity, and at least a portion of the wick is impregnated with the liquid working substance;

a supporting element, disposed in the cavity, adapted to eliminate deformation due to pressure on the housing generated by external atmosphere and evaporation of the liquid working substance;

a side edge of the heat radiating base plate is connected with the mounting assembly.

It can be seen from the above technical solution, the heat radiation device for a lighting device provided by the present invention adopts a heat radiating base plate, a housing and heat radiating fins connected with each other to form a passive heat radiator so as to implement heat radiating, transmit heat to a two-dimensional plane for heat radiating, increase heat radiating area and improve heat radiating effect. Besides, when the heat radiating base plate is under a mounting status, the housing and the heat radiating fins are substantially perpendicular to a horizontal plane, which implements a status that the housing and the heat radiating fins are both substantially parallel to a gravity direction. Because air has a flowing trend that hot air rise up and cold air drops down, the direction of a channel for air flowing between the heat radiating fins and the housing is consistent with the direction of natural hot air flowing, which facilitates improving heat radiating effect. In another aspect, the heat radiating fins commonly disposed vertically can also play a role of guiding things such as rain water and dust flowing downwards to outside of the heat radiator. Still in another aspect, the cavity of the housing has liquid working substance and wick, the capillarity of the wick makes the liquid working substance distribute in the wick, even if in the case of the housing is in a heeling condition, the bottom of the housing can still contact with the liquid working substance in the wick, thus can improve heat radiating effect.

In order to accomplish the above subject, the present invention further provides a heat radiation device for a lighting device, comprising a passive heat radiator and a mounting assembly, wherein:

the passive heat radiator, comprises:

a heat radiating base plate;

a slablike upstanding plate, the slablike upstanding plate is a solid plate of metal material;

a heat absorbing ending face disposed at one side of the heat radiating base plate deviated from the upstanding plate, and adapted to mount a luminous chip of the lighting device;

heat radiating fins connected to a surface of the slablike upstanding plate, the heat radiating fins are of hollow cubic tubular structure;

the heat radiating base plate is connected with the mounting assembly.

It can be seen from the above technical solution, the heat radiation device for a lighting device provided by the present invention adopts a heat radiating base plate, a slablike upstanding plate and heat radiating fins connected with each other to form a passive heat radiator so as to implement heat radiating, transmit heat to a two-dimensional plane for heat radiating, increase heat radiating area and improve heat radiating effect. Besides, when the heat radiating base plate is under a mounting status, the upstanding plate and the heat radiating fins are substantially perpendicular to a horizontal plane, which implements a status that the upstanding plate and the heat radiating fins are both substantially parallel to a gravity direction. Because air has a flowing trend that hot air rise up and cold air drops down, the direction of a channel for air flowing between the heat radiating fins and the housing is consistent with the direction of natural hot air flowing, which facilitates improving heat radiating effect. In another aspect, the heat radiating fins commonly disposed vertically can also play a role of guiding things such as rain water and dust flowing downwards to outside of the heat radiator. Still in another aspect, the heat radiating fins are of hollow cubic tubular structure, and forms an air passage from top to bottom, thus can further improve heat radiating effect.

| | | |
|---|---|---|
| 1- bulb | 2- bulb holder | 3- heat radiating base plate |
| 4- heat radiating fin | 11- housing | 12- heat absorbing ending face |
| 13- wick | 14- thermal conductivity supporting plate | 15- mounting seat |

-continued

| | | |
|---|---|---|
| 16- connecting seat | 17- sealing cover | 20- reflecting plate |
| 21- heat radiating area | 22- lamp room area | 23- wind inlet hole |
| 24- wind outlet hole | 25- wind inlet draining sheet | 26- wind outlet draining sheet |
| 27- groove | 28- projection | 29- lamp cap |
| 100- heat radiating loop tube | 110- evaporating end | 120- wick |
| 130- condensing end | 31- dummy club | 32- mounting hole |
| 33- via hole | 34- bolt | 35- ventilation cleaning hole |
| 36- mounting pit | 37- first soldering side surface | 38- second soldering side surface |
| 39- underside surface | 40- first siding wall | 41- second siding wall |
| 42- first wedge portion | 43- second wedge portion | 44- connection |
| 45- wind inlet | 46- wind outlet | 47- slablike upstanding plate |
| 48- hanging-wall member | 49- side-wall member | 50- mounting housing |
| 51- lamp-post connecting piece | 52- mounting opening | 53- air opening |
| 54- power supply | 55- transversal beam | 56- longitudinal beam |
| 57- supporting component | | |

DETAILED DESCRIPTION

The present invention is described in detail below through embodiments with reference to the accompanied drawings.

Embodiment 1 of the Passive Heat Radiator

Figure 1:
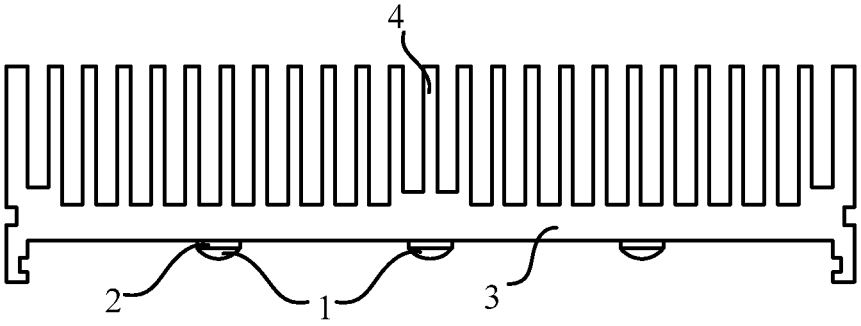
Fig. 1 (Prior Art)
FIG. 1 is a structural schematic view of a heat radiation device of a lighting device in prior art.
Figure 2:
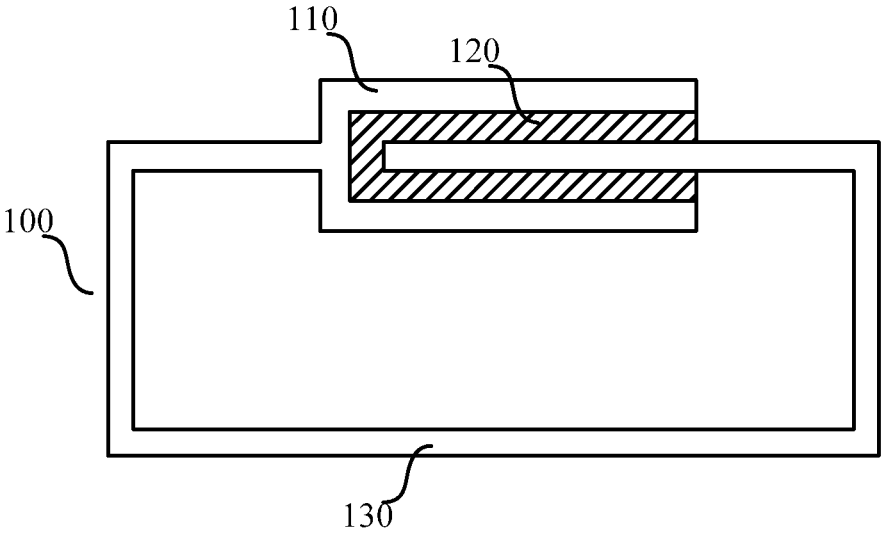
Fig. 2 (Prior Art)
FIG. 2 is a schematic view showing the heat radiating principal of LHP in prior art.
Figure 3:
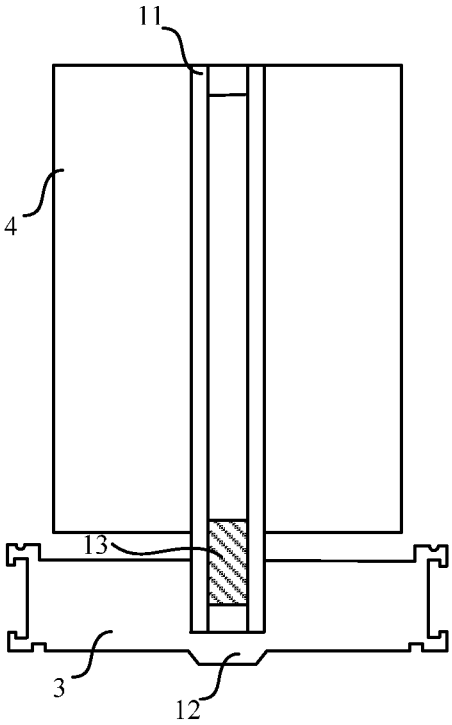
FIG. 3 is a cross sectional view of the passive heat radiator of Embodiment 1 in the present invention.
Figure 4:
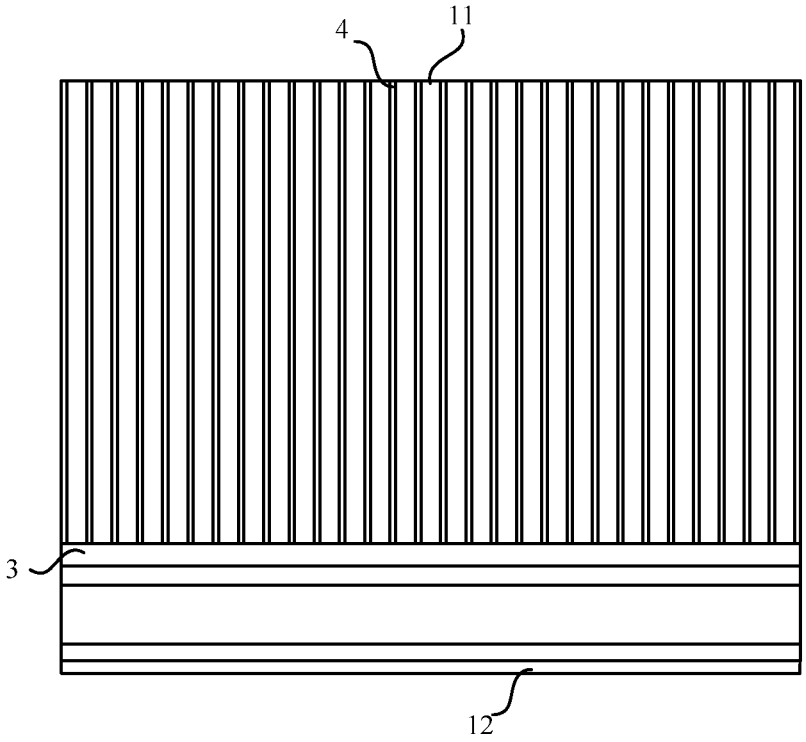
FIG. 4 is a side view of the passive heat radiator of Embodiment 1 in the present invention.

Shown in FIG. 3 is a cross sectional view of the present invention passive heat radiator of Embodiment 1. FIG. 4 is a structural schematic side view of the passive heat radiator of the Embodiment 1 of the present invention. The passive heat radiator includes a heat radiating base plate 3, a housing 11 a heat absorbing ending face, a wick 13 and heat radiating fins 4. The heat radiating base plate 3 usually can be of a rectangular plate structure with a rectangular cross section. The housing 11 can be a slablike sealing housing and usually has a rectangular surface and may be fixedly connected to the top surface of the heat radiating base plate 3 or partially embodied into the heat radiating base plate 3, vertical to or in a certain angle with the upper surface of the heat radiating base plate 3, by way of brazing. Depending on requirement for heat radiating situations, there may be disposed one housing 11 or multiple housings 11 abreast. The inner cavity of the housing 11 is evacuated to vacuum during operation and poured with liquid working substance having heat evaporation characteristics. Generally speaking, the housing 11 may be buckled by two panels; a plate frame surrounds outside the panels for sealing and fixing the two panels; a pouring port may be further disposed on the plate frame of the housing 11 for pouring part or some liquid working substance. The heat absorbing ending face is disposed on one side surface of the heat radiating base plate 3 opposite from the housing 11. There can be one or more heat absorbing ending faces 12. The heat absorbing ending face may be a planar surface or a lug boss or a notch for mounting or pasting a heat generating element, and absorbs heat from the heat generating element in a concentrated manner. The above pouring port is preferably disposed far from the heat absorbing ending face. The wick 13 may be disposed in the housing 11 and fixed on the inner wall of the housing 11. For example, the wick 13 can be fixed on the inner wall of the housing 11 by the way of soldering and disposed at the inner side of the housing 11 adjacent to the heat absorbing ending face for collecting the liquid working substance to the bottom of the housing 11 through capillarity, i.e. collecting it close to the heat absorbing ending face. The heat radiating fins 4 may be fixedly connected to the surface(s) at one side or two sides of the housing 11 by the way of soldering, preferably disposed perpendicularly to the surface of the housing 11. Further more, the heat radiating fins 4 may be perpendicular to the heat radiating base plate 3 and vertically disposed at two sides of the housing 11. As shown in FIG. 4, when the heat radiating base plate 3 is under a mounting status, the heat radiating fins 4 are perpendicular to the horizontal plane. The heat radiating base plate 3 in the present embodiment is disposed horizontally under the mounting status so that the heat radiating fins 4 are perpendicular to the heat radiating base plate 3.

Alternatively, heat radiating fins 4 may also be parallel to the heat radiating base plate 3 or be disposed in a certain angle or in a certain pattern which may be selected according to requirement of heat radiating environment as long as they can expand heat radiating area and guide cold air for circulation.

Figure 29:
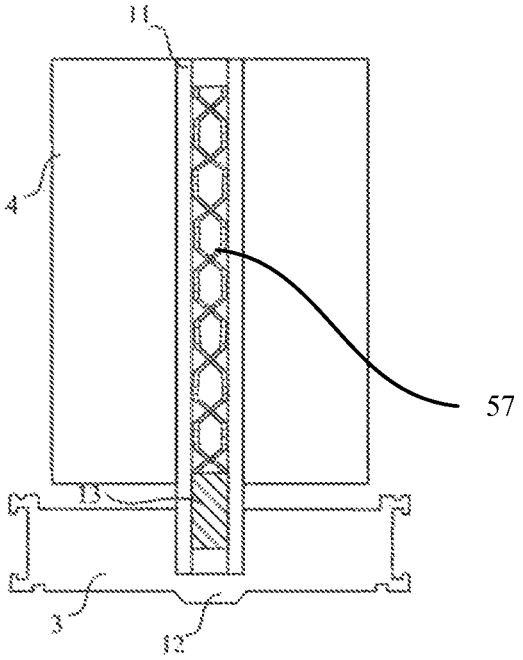
FIG. 29 is another cross sectional view of the passive heat radiator of Embodiment 1 in the present invention.

In the housing 11 of the passive heat radiator according to the present embodiment, a supporting component 57 may be further disposed, as shown in FIG. 29. The supporting component 57 may be specifically disposed in the inner cavity of the housing, fixedly connected to the inner surfaces of the two panels of the housing 11 by soldering, on one hand, adapted for supporting the walls, such as the two panels, of the housing 11 so as to eliminate the impact of inward deformation caused due to the pressure generated by external atmosphere on the housing, on the other hand, adapted for pulling the walls, such as the two panels, of the housing 11 tightly so as to eliminate the impact of outward deformation caused due to the pressure generated by vaporization of inner liquid working substance on the housing.

In specific practice, the wick and the supporting component may be disposed in combination. The wick may be a structure of welded films with micro-channels, may be a prefabricated weaving net, strands, lines, a sintering structure of nets, silks and particles, or other wick with a preset structure. The supporting component may be a supporting structure made of sheet material through pressure processing or may be a reticular structure having supporting points at the top and bottom and having a large number of pores in the middle which are knitted by metal wires. The supporting component is connected with the inner wall of the housing 11 through soldering. By disposing a dense-honeycomb-shaped supporting component, the supporting component may have capillarity function of the wick to guide the liquid working substance flowing to the heat absorbing ending face. The wick may also use high-strength material and is fixedly connected to the inner wall of the housing so as to have both the effect of capillarity and the effect of supporting and pulling tightly the housing. When prepared by techniques such as sintering, the wick may be disposed only at one end in the housing adjacent to the heat radiating base plate 3, and the supporting component may be disposed at the part in housing 11 where no wick is disposed so as to avoid the impact of the wick on the fixed connection between the supporting component and the side wall of the housing 11, and enable the supporting component to bear the force caused by inward and outward deformation of the housing.

The passive heat radiator according to the present embodiment makes use of a vapor chamber heat radiating principle and uses a phase transition process in which heat is absorbed when liquid is evaporated and heat is released when steam is condensed to transmit vaporization latent heat. The specific process of heat radiating is as follows: the heat absorbing ending face may absorb heat from the heat generating element attached thereon; one end of the housing adjacent to the heat absorbing ending face is the evaporating end where the liquid working substance absorbs heat, is evaporated into gaseous state, and spread within all over the housing gradually; a part in the housing far from the heat absorbing ending face may be called the condensing end; the outer side of the condensing end of the housing is connected with heat radiating fins or directly contacts with cold air; when the working substance in gaseous state spreads to the condensing end, heat spreads to air via the wall of the housing directly or indirectly via heat radiating fins; after the working substance in gaseous state is condensed into liquid, the liquid flows back; the wick disposed at the inner side of the housing adjacent to the heat absorbing ending face may attract the liquid working substance by capillarity action and collect it into the wick, i.e. collect the working substance to the place adjacent to the heat absorbing ending face for the next heat radiating circulation.

When the housing is placed in an inclined state relative to the horizontal plane, the wick disposed at the bottom of the housing is also in an inclined state correspondingly, at this state, due to the effect of gravity, the surface of the liquid working substance is in parallel with the horizontal plane, the liquid working substance can gather at one side of the bottom in the cavity of the housing, making a portion of the inner bottom surface of the housing cannot directly contact with the liquid working substance without the wick. Now, since part of the wick is dipped into the liquid working substance, the capillarity action of the wick will absorb the liquid working substance into the wick and make the liquid working substance distribute in the wick relatively uniformly, thus the above mentioned portion of the inner bottom surface of the housing can contact with the liquid working substance in the wick. With the setting of the wick, the passive heat radiator can guarantee heat radiation effect even if the housing is in an inclined state.

In the present embodiment, a planer heat plate constructed by the sealed housing is preferably disposed in such a manner that its main heat conducting surface lies in a direction parallel with the gravity direction, that is, when the heat radiating base plate is under the assembled state, the main heat conducting surface of the heat plate is perpendicular to the horizontal plane and parallel with the gravity direction. Alternatively, when the heat radiating base plate is under the assembled state, the main heat conducting surface of the heat plate may have a first angle with the horizontal plane. The first angle is preferably greater than 60 degrees so that the heat plate has a small angle with gravity direction for accommodating a flowing direction of cold and hot air convection to some extent.

In the present embodiment, the heat radiating fins are also preferably disposed in such a manner that its main heat conducting surface lies in a direction parallel to the gravity direction, that is, when the heat radiating base plate is under the assembled state, the main heat conducting surface of the heat radiating fins is perpendicular to the horizontal plane and parallel with the gravity direction. Alternatively, when the heat radiating base plate is under the assembled state, the main heat conducting surface of the heat radiating fins may also have a second angle with the horizontal plane and the second angle is preferably greater than 60 degrees so that the heat radiating fins have a small angle with gravity direction for accommodating a flowing direction of cold and hot air convection to some extent.

Because the heat radiating base plate in the present embodiment is disposed horizontally when it is under the mounting status, the heat plate, the heat radiating base plate and the heat radiating fins are soldered together mutually perpendicular to each other as shown in FIGS. 3 and 4. According the principal that hot air rises up and cold air falls down, the direction of a channel for air flow between the heat radiating fins and the upstanding plate can be made consistent with the direction of cold and hot air convection, and can also be the same as the transmitting direction of the heat in the heat plate, which facilitates the heat radiating effect, and at the same time, the heat radiating fins commonly disposed vertically can also play an role of guiding things such as rain water and dust flowing downwards to the outside of the heat radiator.

In the passive heat radiator according to the present embodiment, the sealed housing filled with the liquid working substance is a plate-shaped heat plate structure which utilizes a two-dimensional plane phase change heat transmitting structure of the plate-shaped housing to evenly transmit the heat absorbed from the heat generating element to all over the heat plate surface, and transmit the heat to the cold air contacting with the heat radiating fins via the metal heat radiating fins fixed on the heat plate surface by soldering, which implements the passive heat radiating. In an embodiment, the sealed housing includes two parallely arranged planer heat plates defining a cavity there between, each of the heat plate has an inner main heat conducting surface and an opposite outer main heat conducting surface with the inner main heat conducting surfaces of the two heat plate facing each other. The heat plate with a two-dimensional plane have large heat radiating area and the heat radiating performance is far superior to the heat radiating performance of a tube-shaped heat pipe. At the same time, the heat plate structure is different from a heat pipe in terms of bearing the impact on housing deformation caused by inner positive pressure and negative pressure of the housing. The housing has more deformation tendency. In the present embodiment, the supporting component provided within the heat plate housing can effectively solve this problem. The passive heat radiator according to the present embodiment has a higher heat radiating efficiency, simple structure, and low cost, which is easy to be promoted and realized.

Embodiment 2 of the Passive Heat Radiator

Figure 5:
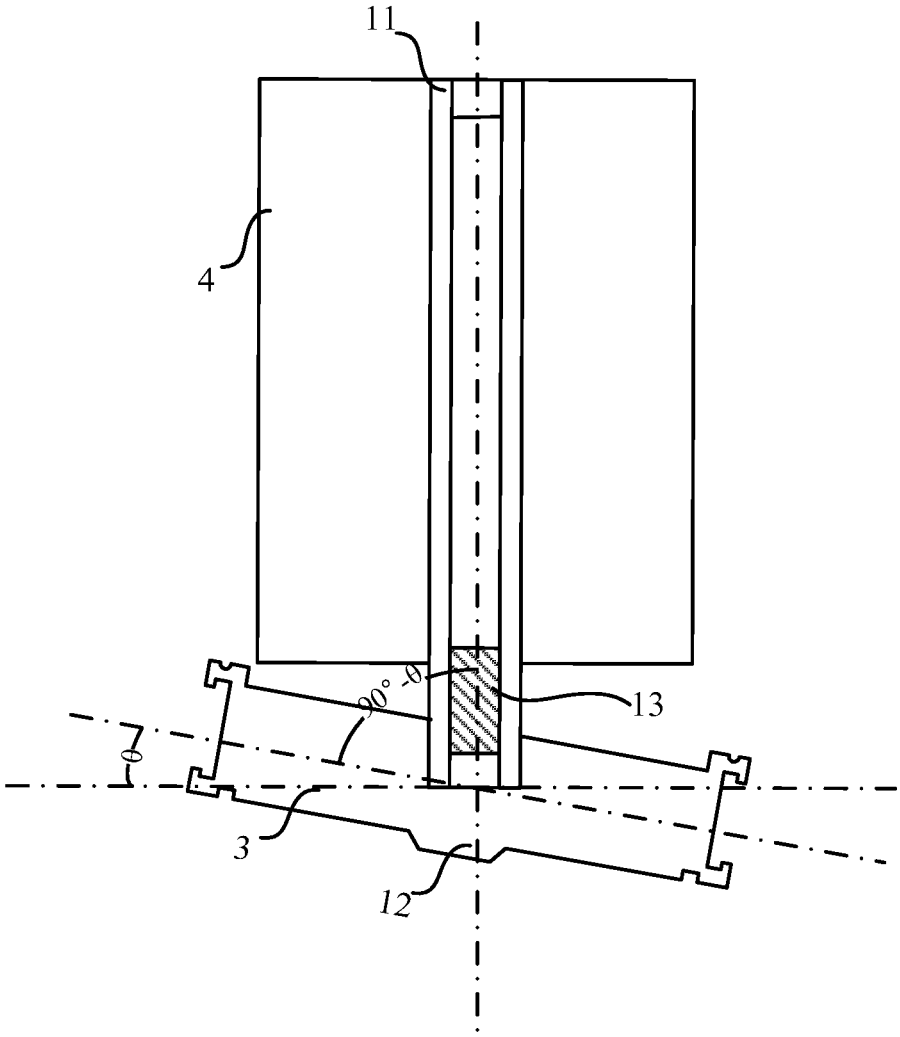
FIG. 5 is a structural schematic view of the passive heat radiator of Embodiment 2 in the present invention.

Shown in FIG. 5 is a structural schematic view of Embodiment 2 of the passive heat radiator in the present invention. Compared with Embodiment 1, the present embodiment has the following differences: when the heat radiating base plate 3 is under the mounting status, it has an angle θ with the horizontal plane, thus the housing 11 correspondingly has an angle 90°-74 with the heat radiating base plate 3 which enable the housing 11 to keep parallel to the gravity direction as the heat radiating base plate 3 is being mounted.

Embodiment 3 of the Passive Heat Radiator

Figure 6:
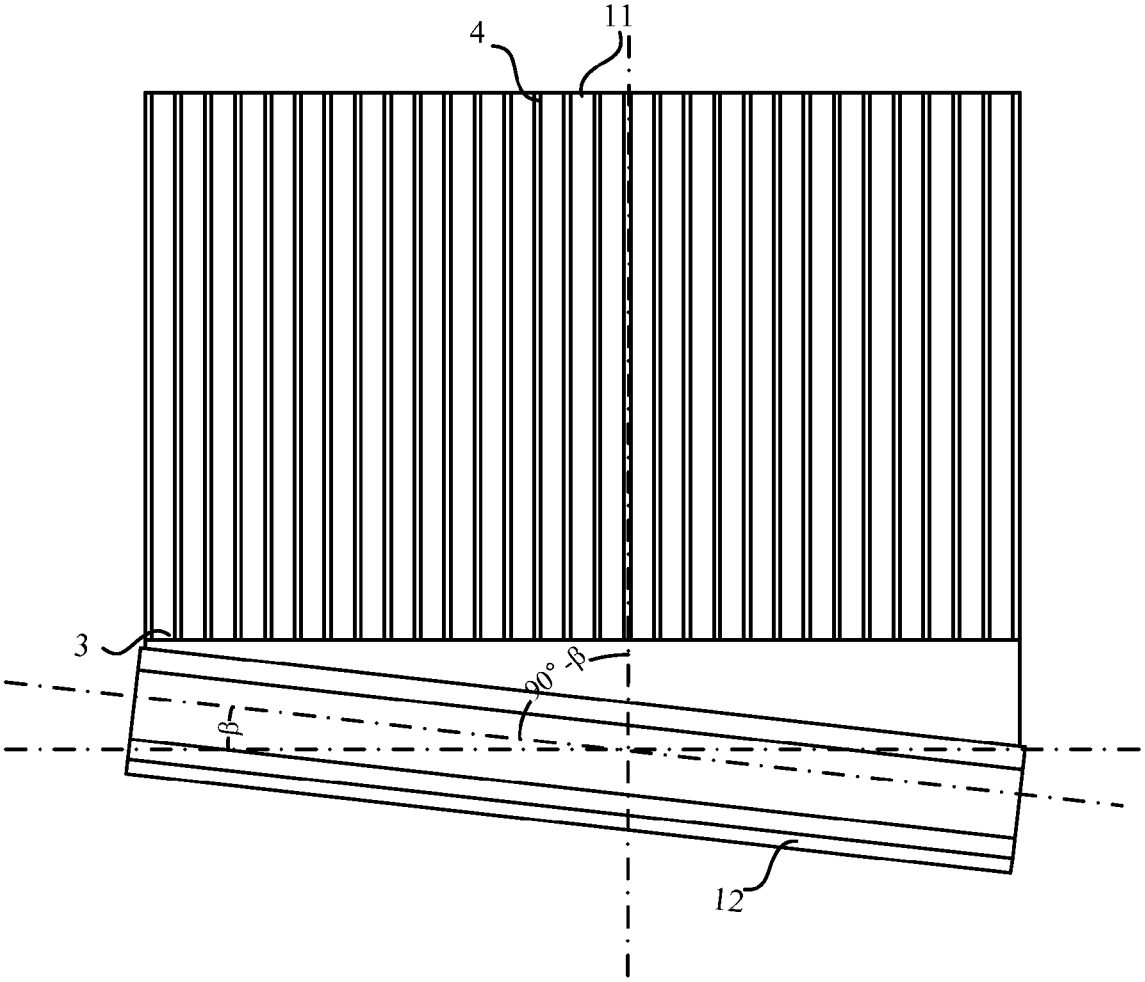
FIG. 6 a structural schematic view of the passive heat radiator of Embodiment 3 in the present invention.

Shown in FIG. 6 is a structural schematic view of Embodiment 3 of the passive heat radiator in the present invention. Compared with Embodiment 1, the present embodiment has the following differences: when the heat radiating base plate 3 is under the mounting status, it has an angle β with the horizontal plane, thus the heat radiating fins 4 corresponding has an angle 90°-β with the heat radiating base plate 3 which enables heat radiating fins 4 to still keep parallel to the gravity direction as the heat radiating base plate 3 is being mounted.

In the above passive heat radiator in Embodiments 2 and 3, the heat radiating base plate 3 is not parallel to the horizontal plane when it is under the mounting status. In such a housing, the heat plate and the heat radiating fins, or their main heat conducting surfaces can keep parallel to the gravity direction as they are mounted through changing relative position relationship between the heat radiating fins or the housing and the heat radiating base plate 3.

Embodiment 4 of the Passive Heat Radiator

Figure 7:
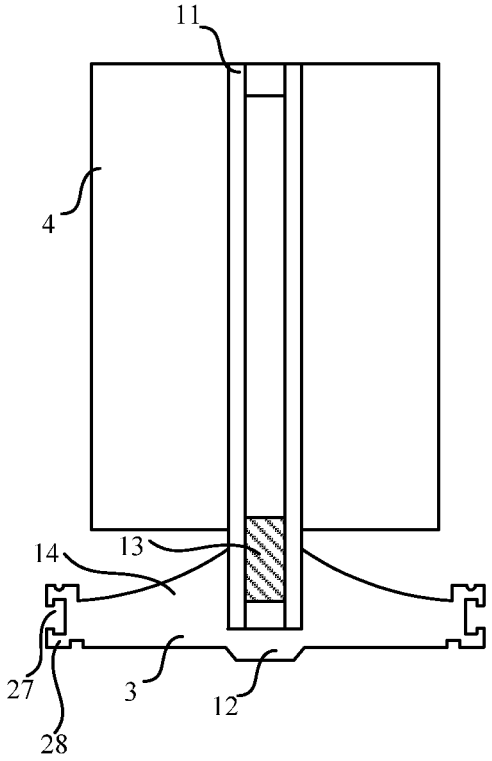
FIG. 7 is a cross sectional view of the first implementing mode of the passive heat radiator of Embodiment 4 in the present invention.

Shown in FIG. 7 is a cross sectional view of the first implementing mode of the passive heat radiator of Embodiment 4 in the present invention. In Embodiments 1, 2, 3, the heat radiating base plate 3 may have a substantially planner upper surface. Compared with Embodiment 1, the present embodiment has the following differences: the cross section of the heat radiating base plate 3 has an approximate isoscelestriangle shape as viewed in a direction perpendicular to the heat radiating fins 4. The specific shape is shown in FIG. 7. Two sides of the approximate isoscelestriangle are arc recessed to inside. This shape may also be called saddle shape. The top angle of the approximate isoscelestriangle (when viewed in a direction perpendicular to the heat plate, it is the top edge of the heat radiating base plate 3) is connected with the bottom end of the housing 11; bottom ends of the heat radiating fins 4 are flush with the top angle of the approximate isoscelestriangle (i.e., the top edge of the heat radiating base plate 3), that is, a gap for ventilation is formed between the two sides of the approximate isoscelestriangle and the heat radiating fins 4 so as to facilitate cold air flowing between the heat radiating fins 4 and the heat radiating base plate 3, and form circularly fluid flow between the heat radiating fins 4. In addition, for the passive heat radiator used by exposure to external environment, the gap can also facilitate draining things such rain water and dust and being cleaned.

The saddle-shaped heat radiating base plate 3 may be molded integrally or formed by fixedly connecting a saddle-shaped thermal conductivity supporting plate 14 and a planar plate by way of soldering. As shown in FIG. 7, the thermal conductivity supporting plate 14 is soldered on the lower portion of two sidewalls of the housing 11 where the wick 13 is located, which can increase the heat contacting area between the heat radiating base plate 3 and the evaporating end in the heat plate. The curve at two sides of the saddle can guide the heat in the planar plate at the bottom of the heat radiating base plate 3 into the wick 13 in the housing 11 and strengthen heat radiating effect.

Figure 8:
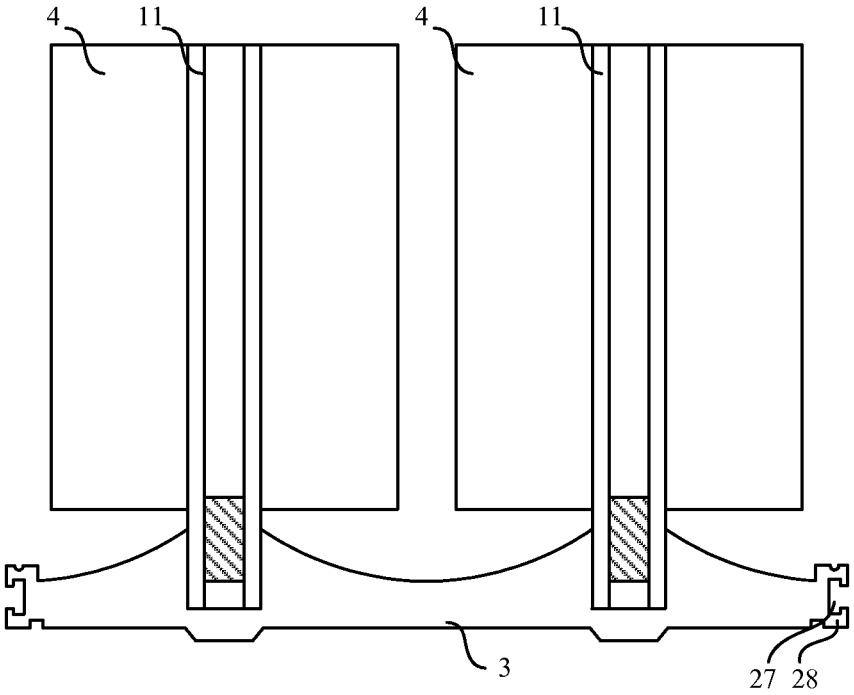
FIG. 8 is a cross sectional view of the second implementing mode of the passive heat radiator of Embodiment 4 in the present invention.
Figure 9:
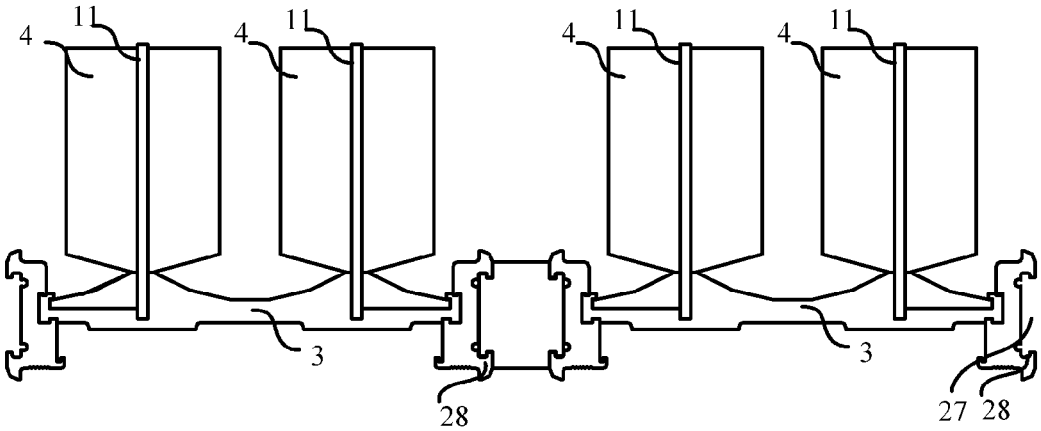
FIG. 9 is a cross sectional view of the third implementing mode of the passive heat radiator of Embodiment 4 in the present invention.
Figure 10:
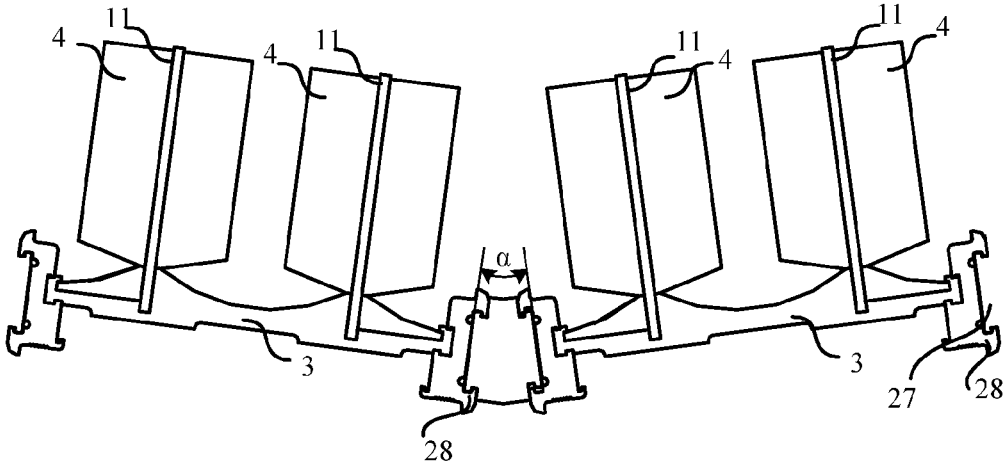
FIG. 10 is a cross sectional view of the fourth implementing mode of the passive heat radiator of Embodiment 4 in the present invention.
Figure 11:
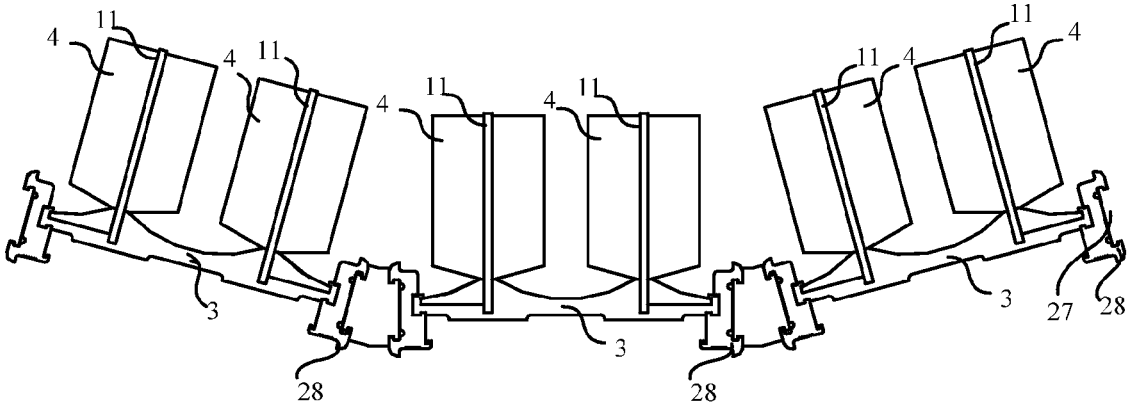
FIG. 11 is a cross sectional view of the fifth implementing mode of the passive heat radiator of Embodiment 4 in the present invention.
Figure 12:
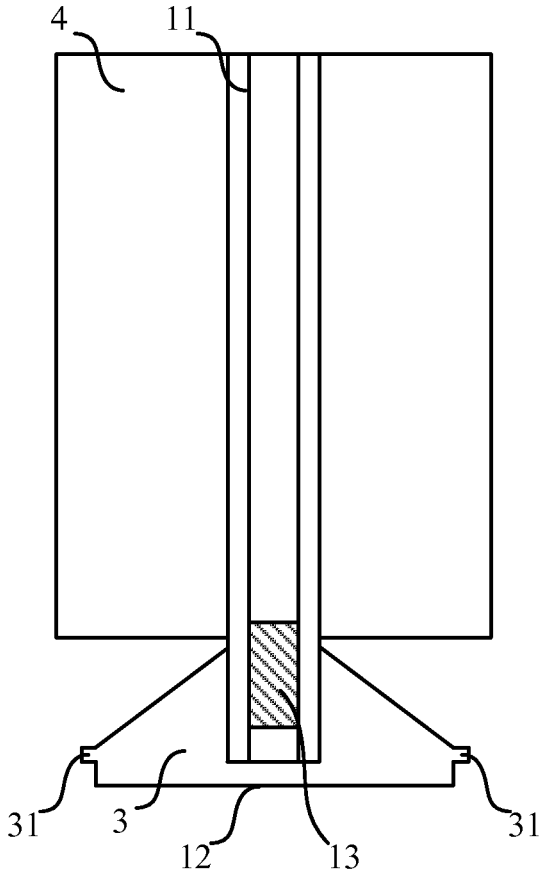
FIG. 12 is a cross sectional view of the sixth implementing mode of the passive heat radiator of Embodiment 4 in the present invention.

In practical application, regarding the passive heat radiator of the present embodiment, there may be many kinds of cross section shapes of the heat radiating base plate 3 such as isoscelestriangle. Shown in FIG. 8 is a heat radiating base plate 3 with two saddle-shaped sections connected to each other, each for receiving one housing 11. The housings 11 and the heat radiating fins 4 thereof are respectively disposed at the top end of two saddle-shaped. A groove 27 and/or a projection 28 which can engage by concave and convex with a connecting attachment may further be disposed at two sides of the heat radiating base plate 3, as shown in FIGS. 7 and 8, so as to conveniently connect two passive heat radiators via the connecting attachment. For example, as shown in FIGS. 9, 10 and 11, they are schematic views of connecting status of multiple passive heat radiators. FIG. 9 shows a structure that the two passive heat radiators shown in FIG. 8 are connected side by side in parallel through the connecting attachment. FIG. 10 shows a structure that the two passive heat radiators shown in FIG. 8 are connected side by side and forming an angle $\alpha$ between the vertical axis of the radiators. FIG. 11 shows a structure that the three passive heat radiators shown in FIG. 8 are connected side by side and forming an angle between the vertical axis of the radiators. In specific implementation, when the mounting position of the heat radiating base plate 3 is not parallel to the horizontal plane, the passive heat radiators in FIG. 5 or 6 may also be combined with each other according to the specific situations. In order to implement the connection with certain angle, a special connecting attachment may be disposed to be connected with passive heat radiators, such as radiators of the same type and shape. The angle formed between the passive heat radiators may be determined by the connecting attachment, i.e. determined by the angle $\alpha$ between the grooves on the connecting attachment for connecting passive heat radiators. Alternatively, dummy clubs 31 may be disposed at two sides of the heat radiating base plate 3, as shown in FIG. 12, which is adapted to facilitate installation of the passive heat radiator into a device which needs heat radiating. The above technical solution may implement handy assembly through setting the passive heat radiators to be standardized components so as to accommodate a variety of heat radiating requirement and passive heat radiator mounting requirement. The passive heat radiator bases on the passive heat radiating principal of a two-dimensional plane heat plate and may be mounted onto various heat generating devices by being mounted or attached into the heat generating element for heat radiating.

Embodiment 5 of the Passive Heat Radiator

Embodiment 5 of the passive heat radiator in the present invention may be based on the above embodiments with the following difference: a solid metal panel may be used to replace the sealed hollow housing to form a slablike upstanding plate. The upstanding plate is connected to the heat radiating base plate by soldering. When the heat radiating base plate is under the mounting status, the upstanding plate is perpendicular to the horizontal plane or has a first angle with the horizontal plane. The first angle is preferably greater than 60 degrees so as to keep the upstanding plate has a small angle with the gravity direction. The heat absorbing ending face is disposed at one side of the heat radiating base plate deviated from the upstanding plate. The heat radiating fins are connected to one side surface or two side surfaces of the upstanding plate by soldering, preferably disposed perpendicular to the surface of the upstanding plate and perpendicular to the horizontal plane or having a second angle with the horizontal plane when the heat radiating base plate is under the mounting status. The second angle is preferably greater than 60 degrees and keeps a small angle between the heat radiating fins and the gravity direction.

The technical solution of the present embodiment makes the direction of air flow channels formed between the upstanding plate and each heat radiating fins consistent with the direction of cold and hot air convection by designing a relative position relationship of the upstanding plate, heat radiating base plate and the heat radiating fins so as to form convection circulation and improve heat radiating effect. The specific form of the upstanding plate is not limited to the above mentioned plate-shaped heat tube or metal solid panel, but it may also be selected from other plate-shaped heat radiating bodies with good heat radiating performance according to specific situations.

Embodiment 1 of the Heat Radiation Device of a Lighting Device

Figure 13:
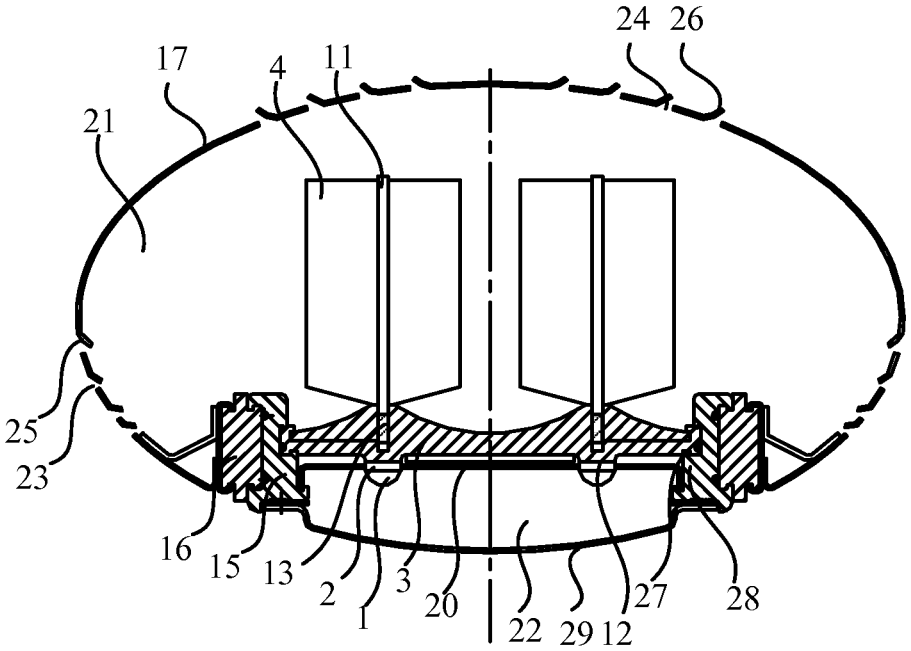
FIG. 13 is a structural schematic view of the heat radiating device for a lighting device of Embodiment 1 in the present invention.

Shown in FIG. 13 is a structural schematic view of the heat radiating device for a lighting device of Embodiment 1 in the present invention. The heat radiation device for a lighting device may adopt the passive heat radiator of the present invention as the heat radiating structure. The passive heat radiator specifically includes: a heat radiating base plate 3, a slablike sealed housing 11 fixedly connected to the heat radiating base plate 3 by soldering, in which the cavity in the housing 11 is under vacuum and is poured with liquid working substance having heat evaporation characteristics; a heat absorbing ending face 12 disposed at one side of the heat radiating base plate 3 deviated from the housing 11 and adapted to mount a heat generating element; a wick 13 disposed in the housing 11 and disposed at the inner side of the housing 11 adjacent to the heat absorbing ending face 12; and heat radiating fins 4 fixedly connected to the surface of the housing 11 by soldering and preferably disposed perpendicular to the surface of the housing 11. Besides, when the heat radiating base plate 3 is under the mounting status, the housing 11 is preferably perpendicular to the horizontal plane or has a first angle with the horizontal plane, and the heat radiating fins 4 are perpendicular to the horizontal plane or have a second angle with the horizontal plane. In the present embodiment, the heat radiating base plate 3 is disposed horizontally when it is under the mounting status, accordingly the housing 11, the heat radiating fins 4 and the heat radiating base plate 3 are perpendicular between each other. Based on the above structures, the heat radiation device of the lighting device further includes mounting seats 15, connecting seats 16 and a sealing cover 17. The heat absorbing ending face 12 is provided with a bulb holder 2 for mounting a streetlight bulb 1 so as to make the heat generating element bulb 1 adjoin the heat absorbing ending face 12, i.e. adjoin the wick 13 for acquire a desirable heat radiating effect. The heat radiating base plate 3 and the mounting seat 15 are respectively provided with a groove 27 and/or a projection 28 at sides thereof which are engaged and hooked together by concave and convex. As shown in FIG. 13, mounting seats 15 are connected to two sides of one heat radiating base plate 3 via the groove 27 and/or projection 28. The side of the mounting seat 15 deviated from the heat radiating base plate 3 is fixed and connected to the connecting seat 16. Specifically, this connection may be implemented by screwing, soldering, bonding, mechanical extrusion or the groove 27 and/or projection 28 engaged and inserted by concave and convex. The sealing cover 17 covers at one side of passive heat radiator where the housing 11 and the heat radiating fins 4 are disposed, and the edge of the sealing cover 17 is connected with the connecting seats 16 so as to form a heat radiating area 21 above the heat radiating base plate 3. There are further many wind inlet holes 23 and wind outlet holes 24 opened on the sealing cover 17 in a shape of rectangular or circular, which can ensure air flowing in the heat radiating area 21.

In the present embodiment, the wind inlet holes 23 may be disposed at the side of the sealing cover 17 adjacent to the connecting seats 16 respectively; the wind outlet holes 24 may be disposed on top of the sealing cover 17 adjacent to the top end of the housing 11. Setting the positions of the wind inlet holes 23 and wind outlet holes 24 facilitates hot air flowing out from the top end and cold air flowing into the bottom side so as to form air circulation in the heat radiating area 21. Further more, wind inlet draining sheets 25 may be further disposed at the edges of wind inlet holes 23. The wind inlet draining sheets 25 are disposed at the inner sides of the sealing cover 17 and extend downwards from up edges of the wind inlet holes 23. Wind outlet draining sheets 26 may be further disposed at the edges of the wind outlet holes 24. The wind outlet draining sheets 26 are disposed at the outer side of the sealing covers 17 and extend outwards from the edges of the wind outlet holes 24 by taking the central line of the sealing cover 17 as symmetry axis. The disposed wind inlet draining sheets 25 and wind outlet draining sheets 26 can guide flowing direction of air so as to strengthen air circumfluent effect in the heat radiating area 21.

In the above embodiments, the heat radiating base plate is provided with a groove and/or projection at two sides thereof. Specifically at least two groups of grooves and/or projections may be disposed at each side. The shape of the groove and/or projection may be T-shaped, rectangular-shaped or swallowtailed. They are engaged and inserted to the corresponding side of the mounting seat together. The heat radiation device of the lighting device of the present embodiment may include multiple passive heat radiators connected with each other through connecting to the mounting seats. The above heat radiation device of the lighting device may implement standardization for convenient assembly so as to acquire a heat radiation device of a lighting device group to provide a heat radiating structure for streetlight with different power. The technical solution is high flexible and easy to assembly, accommodates streetlights with different heat radiating requirements by assembling standardized heat radiating devices, and implements power combination of multiple groups of streetlights to accommodate requirements of specific situations. By adopting mounting seats in different shapes or setting different angles between the grooves and/or projections at two sides of the mounting seat, angle configuration between multiple passive heat radiators can be realized.

The heat radiation device of the lighting device of the present embodiment may further adopt the passive heat radiator in any embodiment of the present invention, further include a supporting component, and adopt a heat absorbing ending face in form of lug boss or notch so as to embody the bulb holder into the heat radiating base plate, which facilities direct heat radiating. The present embodiment can utilize a two-dimensional plane phase change heat transmitting structure of the heat plate to evenly transmit the heat absorbed from the streetlight bulb to the heat plate surface and then transmit the heat to the cold air via the metal heat radiating fins soldered on the heat plate surface so as to implement the passive heat radiating. The heat plate of the passive heat radiator in the present embodiment heat radiation device for a lighting device may also be substituted by a metal solid panel as an upstanding plate. By keeping air channel direction between the upstanding plate and the heat radiating fins substantially consistent with cold air convection direction, convection circulation of cold and hot air is formed so as to strengthen heat radiating effect.

In the above specific embodiments of the heat radiation device for a lighting device, as shown in FIG. 13, a lamp cap 29 may further be fixed and connected to the mounting seat 15 and covers on one side where a bulb holder 2 is disposed. A lamp room area 22 is formed between the lamp cap 29 and the bottom surface of the heat radiating base plate 3. A reflecting plate 20 and a circuit board may be further attached at one side of the heat radiating base plate 3 where a heat absorbing ending face is disposed. The edge of the reflecting plate 20 is fixed and connected to the mounting seats 15. Reflecting plates 20 are disposed between the bulb holders 2 at intervals to play a role of reflecting lights and increasing brightness when the streetlights mounted on the bulb holders 2 give off lights.

In order to realize sealing of the above lamp room area and isolation of the heat radiating area, a sealing groove may be disposed at a place where the mounting seat and the connecting seat are connected. Sealing rings are layout in the sealing groove so as to prevent the circuit board mounted in the lamp room area for driving on-off of the streetlight bulbs from exposure to humid external environment and damage caused by moisture to electrical appliance. In order to facilitate overall installation of the streetlights, screw holes or positioning bolts may be further disposed at center of the heat radiating base plate and/or connecting seats. At the bottom of the heat radiating base plate, an outlet for draining rain water and dust may be further disposed at the position corresponding to the edge of the lamp cap.

The mounting seat and the connecting seat may be molded integrally or be manufactured separately. For example, for the situation that multiple streetlight bulbs are mounted, the number of the passive heat radiators may be at least two, and the number of the mounting seats is one more than that of the passive heat radiators for being connected between the passive heat radiators and being connected between the passive heat radiator and the connecting seat so as to flexibly expand heat radiating ability of the passive heat radiator according to specific requirements. Further more, an angle may be further formed between two sides of the mounting seat where is connected with the heat radiating base plate to form an angle between two passive heat radiators connected to the mounting seat so as to accommodate streetlights in different shapes.

The mounting seat and the heat radiating base plate may also be casted integrally or manufactured separately. When the mounting seat and heat radiating base plate are manufactured separately, they can be prepared by using different material. Material with good heat radiating performance is used to prepare the heat radiating base plate for improving heat radiating performance, bringing down heat radiating requirement to material of the mounting seat, reducing weight, and cutting cost. The separately manufacturing also facilitates flexibly selecting other forms of mounting seat. The mounting seats may be used to combine multiple groups of passive heat radiators, which facilitate providing a suitable heat radiating structure for combining LED streetlights and accommodating light matching angles of multiple groups of LED streetlights multiple groups of LED streetlights.

Embodiment 2 of the Heat Radiation Device for a Lighting Device

Figure 14:
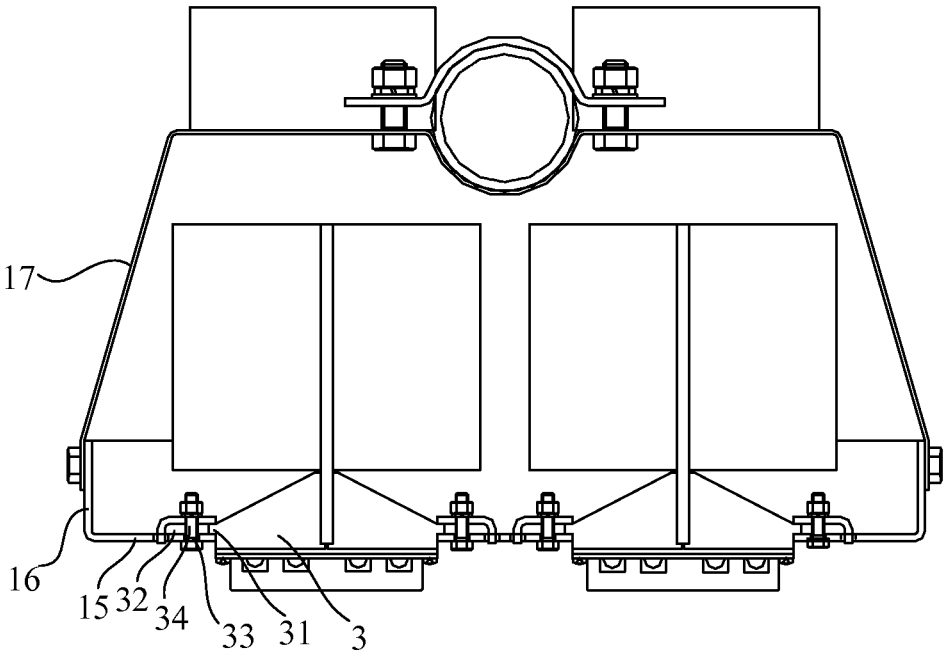
FIG. 14 is a structural schematic view of the heat radiating device for a lighting device of Embodiment 2 in the present invention.

Shown in FIG. 14 is a structural schematic view of Embodiment 2 of the heat radiation device for a lighting device in the present invention. The present embodiment is similar to the Embodiment 1 with following difference: the passive heat radiator is connected with the streetlight housing by way of compression jointing. The heat radiation device for a lighting device may adopt the passive heat radiator of the present invention and further include mounting seats 15, connecting seats 16 and a sealing cover 17. The sealing cover 17 as the streetlight housing is specifically formed by stamping sheet metal. The sides of the connecting seats 16 may be connected with the bottom edge of the sealing cover 17 by a bolt structure etc. The mounting seat 15 and the connecting seat 16 are specifically formed by stamping integrally. A mounting hole 32 is formed by coining in advance at the side of the mounting seat 15 where the passive heat radiator is to be mounted. In the passive heat radiator, a dummy club 31 is disposed at the side of the heat radiating base plate 3 and is embedded into the mounting hole 32 when assembling. Two side surfaces of the mounting hole 32 may be tightly compression jointed on the outer wall of the dummy club 31 so as to fix and connect the passive heat radiator. Specifically, via holes 33 are perfoliately opened on two side surfaces of the mounting hole 32. When assembling, bolts 34 are inserted into the via holes 33 at two sides. The bolts 34 are tightened to make the two side surfaces of the mounting hole 32 pressing tightly onto the dummy club 31. A gasket may be further disposed between the side surfaces of the mounting hole 32 and the outer walls of the dummy club 31. Restriction of the mounting holes 32 and tightening of the bolts 34 can confine the position of the heat radiating base plate 3 in three-dimensional space. As shown in FIG. 14, multiple passive heat radiators may be connected with each other through the mounting seats 15 to accommodate requirements of streetlight in different sizes.

Figure 15:
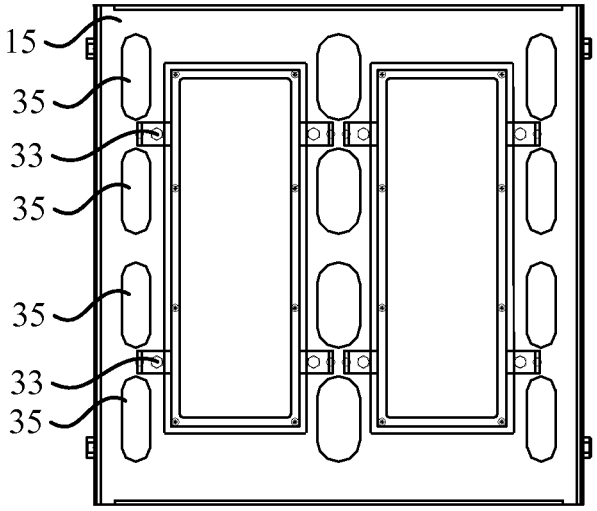
FIG. 15 is a bottom view of the heat radiating device for a lighting device in FIG. 14.

Based on the heat radiation device for a lighting device of the present embodiment and the above Embodiment 1, ventilation cleaning holes 35 may be further perfoliately opened on the mounting seat 15 and/or connecting seat. As shown in FIG. 15, it is a bottom view of the heat radiation device for a lighting device in FIG. 14. The ventilation cleaning holes 35 may be disposed on the two side surfaces of the mounting hole 32 and provided with the via holes 33 at intervals between each other.

The ventilation cleaning holes are adapted for air flowing, and draining rain water and dirt. The gap between heat radiating fins and two side surfaces of the heat radiating base plate may be further adopted on one hand to introduce cold air from outside of the heat radiation device for a lighting device into the passive heat radiator, make the air flow through the heat radiating fins so as to improve heat radiating performance, and on the other hand to wash out dust and dirt coming from atmosphere by rain water obtained from rainfall, remove the dirt away from the heat radiation device for a lighting device via the ventilation cleaning holes. Therefore, the streetlights themselves adopting the heat radiation device for a lighting device of the present embodiment have ability of self-cleaning and good ventilation to facilitate heat radiating.

In the heat radiation device for a lighting device of the present invention, connection way of the passive heat radiator and the mounting seat of the streetlight lamp cap is not only limited to inserting and compression jointing, and may be another way, such as the heat radiating base plate and the mounting seat are fixed and connected by way of being embedded with each other by setting shapes and relative positions of the mounting seat and the heat radiating base plate of the passive heat radiator to make the shapes match with each other.

Embodiment 3 of the Heat Radiation Device for a Lighting Device

Figure 16:
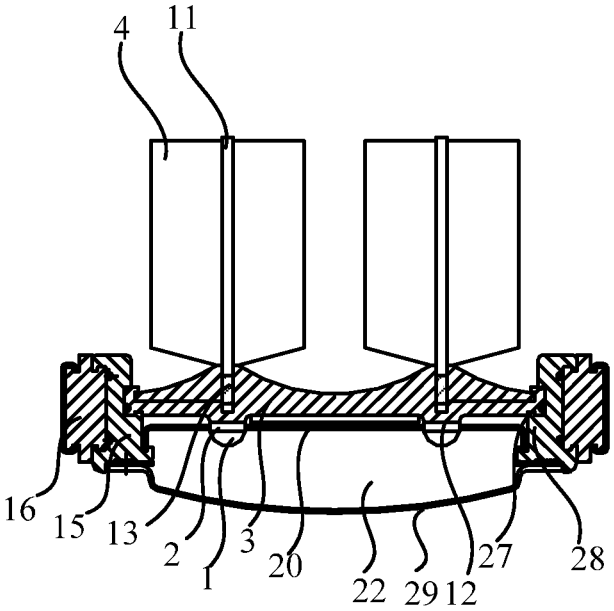
FIG. 16 is a structural schematic view of the heat radiating device for a lighting device of Embodiment 3 in the present invention.

Shown in FIG. 16 is a structural schematic view of the heat radiating device for a lighting device of Embodiment 3 in the present invention. The present embodiment may be based on the above Embodiment 1 or 2 with difference that no sealing cover 17 is disposed so that the upstanding plate and the heat radiating fins 4 of the passive heat radiator both expose to atmosphere for direct heat radiating. During specific mounting, screw holes or slots may be reserved on the connecting seat 16 in advance so as to be directly mounted onto a lamppost. In this heat radiation device for a lighting device, a lamp cap 29 may be further mounted. A lampstrip consisting of multiple bulbs 1 is mounted on the heat radiating base plate 3. The lamp cap 29 covers the bottom of the heat radiating base plate 3 and surrounds the bulbs 1 to form a sealing space.

The technical solution of the present embodiment can further simplify structure design of the heat radiation device for a lighting device so as to greatly reduce cost and processing time and facilitate promotion and application.

The passive heat radiator of the present invention is preferably applied in a streetlight, and more particularly suitable to form multiple heat radiating ending faces arranged in matrix on the heat radiating base plate. Bulb heat sources such as LEDs are mounted respectively to form a plane heat source relatively to the heat radiating base plate so as to transmit heat more evenly and get better heat radiating effect. During mounting the streetlight bulbs, an aluminum alloy plate may be mounted on the heat absorbing ending face for mounting bulb holders and streetlight bulbs. Alternatively, the aluminum alloy plate may also be used to manufacture the heat radiating base plate and the heat absorbing ending face thereof. A multi-layer circuit board may be layout in the area of the heat absorbing ending face. The streetlight bulbs are directly connected to the multi-layer circuit board by soldering. This direct connection may further omit heat transmitting layer and improve heat transmitting effect.

The passive heat radiator of the present invention may be used not only in streetlights, but may also be used in a variety of electric heat generating elements such as used in CPU for heat radiating. With continuous development of existing CPU technology, CPU using 45-nanometer chip technology proposes higher requirements to the heat radiating structure because of miniaturization characteristics. The passive heat radiator of the present invention is especially adapted to the situation acquiring flexible mounting position of heat radiating structure.

Embodiment 4 of the Heat Radiation Device of Lighting Device

Figure 17:
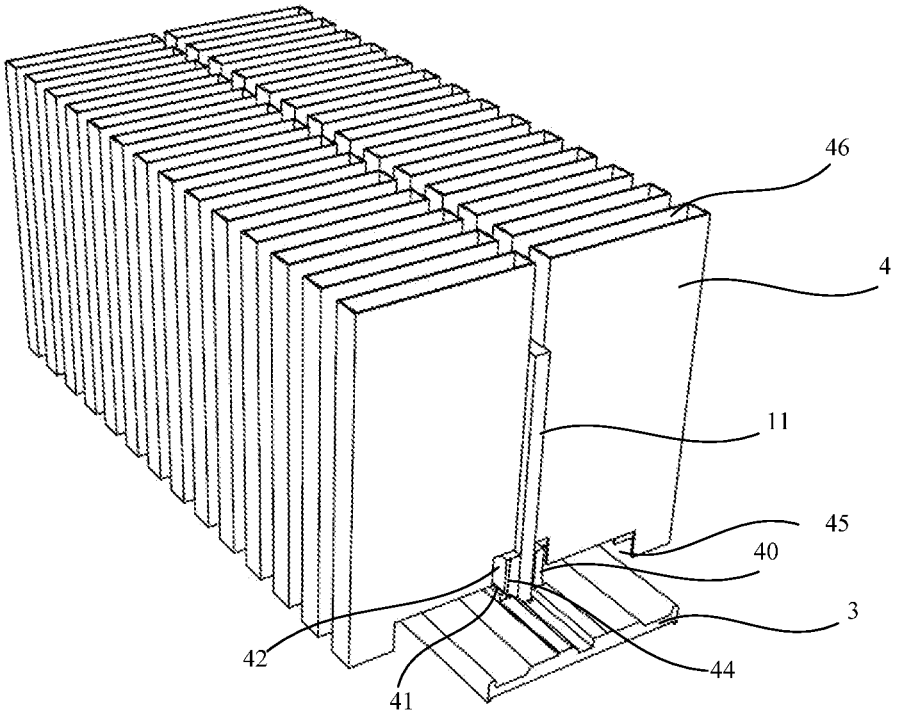
FIG. 17 is a structural schematic view of the passive heat radiator of Embodiment 4 in the present invention.
Figure 18:
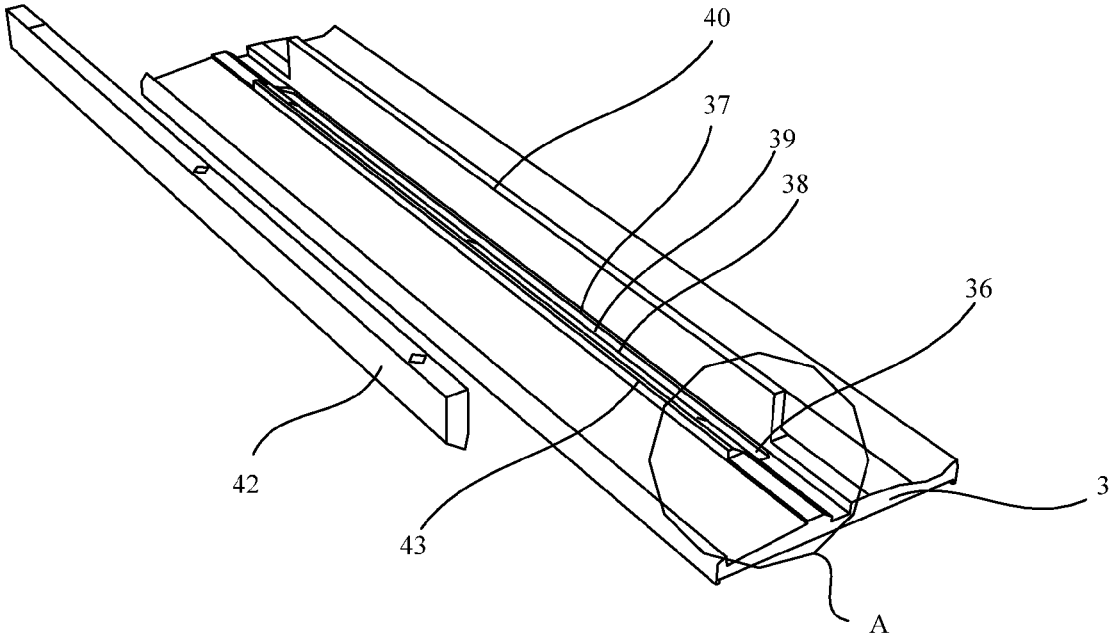
FIG. 18 is a structural schematic view of the heat radiating base plate of the passive heat radiator in FIG. 17.
Figure 19:
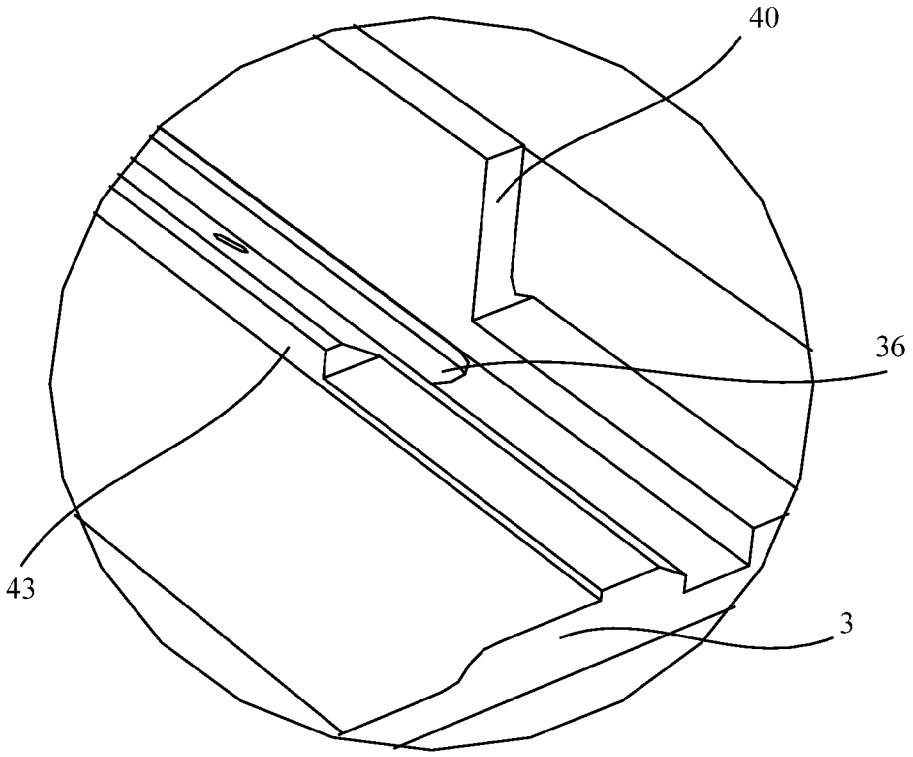
FIG. 19 is schematic view of local amplification of portion A of the heat radiating base plate of the passive heat radiator in FIG. 18.

The passive heat radiator of above embodiments can be achieved by adopting the structure shown in FIG. 17. In the present embodiment, the housing 11 is perpendicular to the heat radiating base plate 3, an upper surface of the heat radiating base plate 3 is provided with a mounting pit 36 as shown in FIG. 18 and FIG. 19, the mounting pit 36 has a first soldering side surface 37 and an opposite second soldering side surface 38, and an underside surface 39 defining a groove, a bottom portion of the housing 11 is inserted into the upper surface of the heat radiating base plate 3 via the mounting pit 36. A first siding wall 40 and a second siding wall 41 are perpendicularly disposed on the upper surface of the heat radiating base plate 3, and a side surface of the first siding wall 40 is coplane with the first soldering side surface 37 of the mounting pit 36. A gap between the first soldering side surface 37 and a first portion of the housing 11 that faces or is in contact with the first soldering side surface 37, and a gap between the second soldering side surface 38 and a second portion of the housing 11 that faces or is in contact with the second soldering side surface 38 are filled with solder. Preferably, the second siding wall 41 comprises a first wedge portion 42 and a second wedge portion 43, a first inclined surface of the first wedge portion 42 corresponds to a second inclined surface of the second wedge portion 43. The first wedge portion 42 is disposed on the upper surface of the heat radiating base plate 3, the second wedge portion 43 is connected with the first wedge portion 42 by a connection such as a bolt, after the bottom portion of the housing 11 inserted into the mounting pit 36, the connection traverses the first inclined surface and the second inclined surface.

Preferably, the heat radiating base plate 3 can be a plate structure of its cross section shaped as a rectangle. The shape of the mounting pit 36 disposed on the heat radiating base plate 3 correspond to the shape of the bottom of the housing 11, and the mounting pit 36 has three surfaces, the first soldering side surface 37, the underside surface 39 and the second soldering side surface 38. The first siding wall 40 is fixed and connected on the upper surface of the heat radiating base plate 3, the first wedge portion 42 of the second siding wall 41 is fixed and connected on the upper surface of the heat radiating base plate 3, due to the vertical surface of the first siding wall 40 is coplane with the first soldering side surface 37 of the mounting pit 36, during actual installation, the housing 11 is inserted into the mounting pit 36, the gaps between the housing 11 and the mounting pit 36 is filled with solder, that is, the gap between the first portion of the housing 11 and the first soldering side surface 37, and the gap between the second portion of the housing 11 and the second soldering side surface 38 are filled with solder, the second wedge portion 43 is disposed on the first wedge portion 42, the first inclined surface of the first wedge portion 42 corresponds to the second inclined surface of the second wedge portion 43. Bolt hole is disposed on the first wedge portion 42 and the second wedge portion 43, the second wedge portion 43 is disposed on the first wedge portion 42 by a bolt traverses through both the bolt holes of the first wedge portion 42 and the second wedge portion 43. During the tightening of the bolt, the vertical surface of the second wedge portion 43 abuts the housing 11 and creates a horizontal force to push the housing 11 and make the housing 11 move towards to the first siding wall 40, and the same time extrude the solder between the housing 11 and the first soldering side surface 37 of the mounting pit 36 and the vertical surface of the first siding wall 40, eliminate the gas in the solder, thus can improve the soldering effect and improve the heat transmitting effect between the heat radiating base plate 3 and the housing 11.

In the present embodiment, the heat radiating fin 4 can be of hollow cubic tubular structure. There are multiple heat radiating fins, disposed on two corresponding surfaces of the housing 11 in two groups. The heat radiating fin 4 is perpendicularly connected to the surface of the housing 11, a first opening is formed at a first end of each of the heat radiating fin 4 proximal to the heat radiating base plate 3 serving as a wind inlet 45, a second opening is formed at a second end of each of the heat radiating fin 4 far to the heat radiating base plate 3 serving as a wind outlet 46.

Preferably, the heat radiating fins 4 are in parallel arrangement, each two heat radiating fins 4 form an air flow channel. In addition, due to the heat radiating fin 4 is of hollow cubic tubular structure, the opening of a proximal end of the heat radiating fin 4 to the heat radiating base plate 3 is the wind inlet 45, the opening of a far end of the heat radiating fin 4 to the heat radiating base plate 3 is the wind outlet 46, and each heat radiating fin forms an air channel, and the channel traverses through the bottom of the heat radiating fin 4 to its top, thus can improve air circulation effect, and improve heat radiating effect. The heat radiating fins 4 shown in FIG. 4, each heat radiating fin is independent, in the present embodiment can make the two adjacent fins shown in FIG. 4 form a hollow cubic tubular heat radiating fin.

Embodiment 5 of the Heat Radiation Device of Lighting Device

Figure 20:
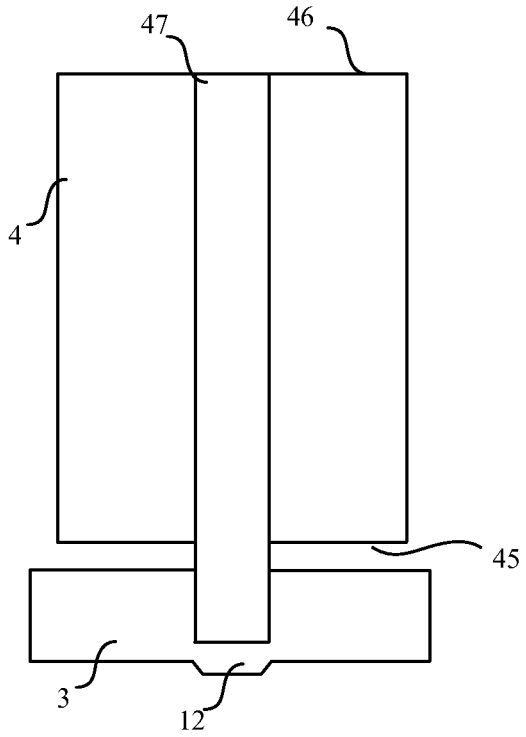
FIG. 20 is a structural schematic view of the heat radiating device for a lighting device of Embodiment 5 in the present invention.

FIG. 20 is a structural schematic view of the heat radiating device for a lighting device of Embodiment 5 in the present invention. The heat radiation device comprises passive heat radiator and mounting assembly, wherein the passive heat radiator comprises a heat radiating base plate 3, a slablike upstanding plate 47, a heat absorbing ending face 12 and heat radiating fins 4. Generally, the heat radiating base plate 3 can be of a rectangular structure, with a rectangular cross section. The slablike upstanding plate 47 is a solid plate of metal material, usually has a rectangular surface and may be fixedly connected to the upper surface of the heat radiating base plate 3 or partially inserted into the heat radiating base plate 3, vertical to or in a certain angle with the upper surface of the heat radiating base plate 3. Preferably, the length of the slablike upstanding plate 47 is less than the length of the heat radiating base plate 3, and in contact with the heat radiating base plate 3 along the entire length of the heat radiating base plate 3. The material of the slablike upstanding plate 47 can be such as aluminum. The heat absorbing ending face 12 is disposed at one side of the heat radiating base plate 3 deviating from the slablike upstanding plate 47, and is adapted to mount a luminous chip of the lighting device, There can be one or more heat absorbing ending faces 12. The heat absorbing ending face 12 may be a planar surface or a lug boss or a notch. Bulb holder can be disposed on the heat absorbing ending face 12, and is used to mount the luminous chip, or a circuit board is disposed within the heat absorbing ending face 12, and the luminous chip is disposed on the heat absorbing ending face 12 and electrically connected with the circuit board. The luminous chip is preferably LED chip, when the luminous chip is LED chip, the lighting device is LED lighting device. The heat radiating fins 4 are of cubic tubular structure, and can be fixed and connected on one side or both sides of the slablike upstanding plate 47 by soldering, preferably disposed perpendicularly to the surface of the slablike upstanding plate 47. Further more, the heat radiating fins 4 may be perpendicular with the heat radiating base plate 3, and disposed erectly at both sides of the slablike upstanding plate 47. Alternatively, heat radiating fins 4 may also be parallel to the heat radiating base plate 3 or be disposed in a certain angle or in a certain pattern which may be selected according to requirement of heat radiating environment as long as they can expand heat radiating area and guide cold air for circulation. There are multiple heat radiating fins 4, each two heat radiating fins 4 form an air channel to guide cold air. In addition, due to the hollow cubic tubular structure of the heat radiating fin 4, each heat radiating fin forms an air channel to guide cold air, which can improve circulation effect, thus improve heat radiating effect. The heat radiating base plate 3 of the passive heat radiator is connected with the mounting assembly, this specifically can be achieved by means of bolt, brazing or paste etc, such that the passive heat radiator is mounted on the mounting position such as the ceiling of a building or the lamp-post by the mounting assembly. Since the mounting position is different, the structure of the mounting assembly can be set according to actual need, the structure shown in FIG. 20 is only for schematic use, and the forms of the mounting assembly will be illustrated in detail in the following embodiments.

In the present embodiment, there are multiple heat radiating fins 4, disposed on two corresponding surfaces of the slablike upstanding plate 47 in two groups. The heat radiating fin 4 is perpendicularly connected to the surface of the slablike upstanding plate 47, an opening of a proximal end of the heat radiating fin 4 to the heat radiating base plate 3 is a wind inlet 45, an opening of a far end of the heat radiating fin 4 to the heat radiating base plate 3 is a wind outlet 46.

In the present embodiment, preferably, the metal material of the slablike upstanding plate 47 above is aluminum, and the slablike upstanding plate 47 of aluminum can improve the heat radiating effect.

Embodiment 6 of the Heat Radiation Device of Lighting Device

Figure 21:
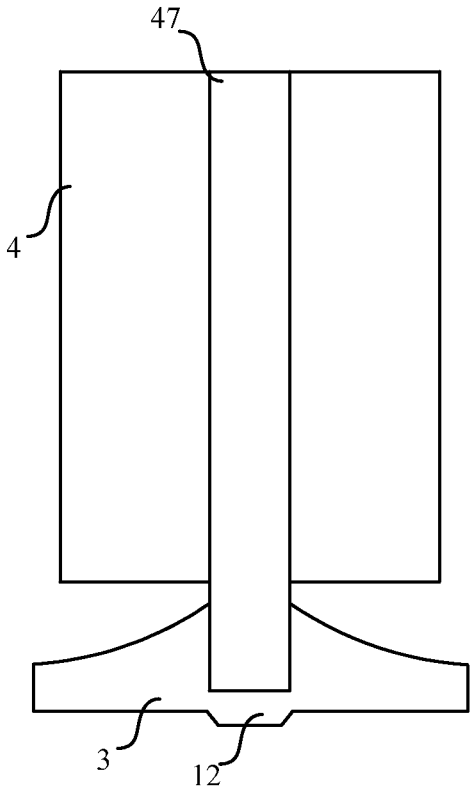
FIG. 21 is a structural schematic view of the heat radiating device for a lighting device of Embodiment 6 in the present invention.

FIG. 21 is a structural schematic view of the heat radiating device for a lighting device of Embodiment 6 in the present invention. Embodiment 6 of the heat radiation device for a lighting device of the present invention can be based on the heat radiation device for a lighting device of Embodiment 5 with the following difference: the upper surface of the heat radiating base plate 3 comprises two curved portions symmetric about a central axis along the length of the heat radiating base plate 3, the two curved portions are curved toward a bottom surface of the heat radiating base plate 3, and a space between the curved portions and a bottom of the heat radiating fins 4 defines a tapered air channel to enhance the air circulation in a first channel defined by the hollow cubic tubular structure of the heat radiating fin 4, and a second channel between the heat radiating fins 4 and the heat radiating base plate 3.

As shown in FIG. 21, the cross section of the heat radiating base plate 3 has an isoscelestriangle shape, and two sides of the approximate isoscelestriangle are arc recessed to inside. This shape may also be called saddle shape. The top angle of the approximate isoscelestriangle is connected with a bottom end of the slablike upstanding plate 47; bottom ends of the heat radiating fins 4 are flush with the point of the top angle of the approximate isoscelestriangle, that is, a gap for ventilation is formed between the two sides of the approximate isoscelestriangle and the heat radiating fins 4 so as to facilitate cold air flowing between the heat radiating fins 4 and the heat radiating base plate 3, and form circularly fluid flow between the heat radiating fins 4. In addition, for the passive heat radiator used by exposure to external environment, the gap can also facilitate draining things such rain water and dust and being cleaned.

The saddle-shaped heat radiating base plate 3 may be molded integrally or formed by fixing and connecting a saddle-shaped thermal conductivity supporting plate and a planar plate by way of soldering. The thermal conductivity supporting plate is soldered out of two sides of the slablike upstanding plate 47, which can increase the contacting area between the heat radiating base plate 3 and the evaporating end in the heat plate. The curve at two sides of the saddle can guide the heat in the planar plate at the bottom of the heat radiating base plate 3 into the slablike upstanding plate 47 and strengthen heat radiating effect.

Embodiment 7 of the Heat Radiation Device of Lighting Device

Figure 22:
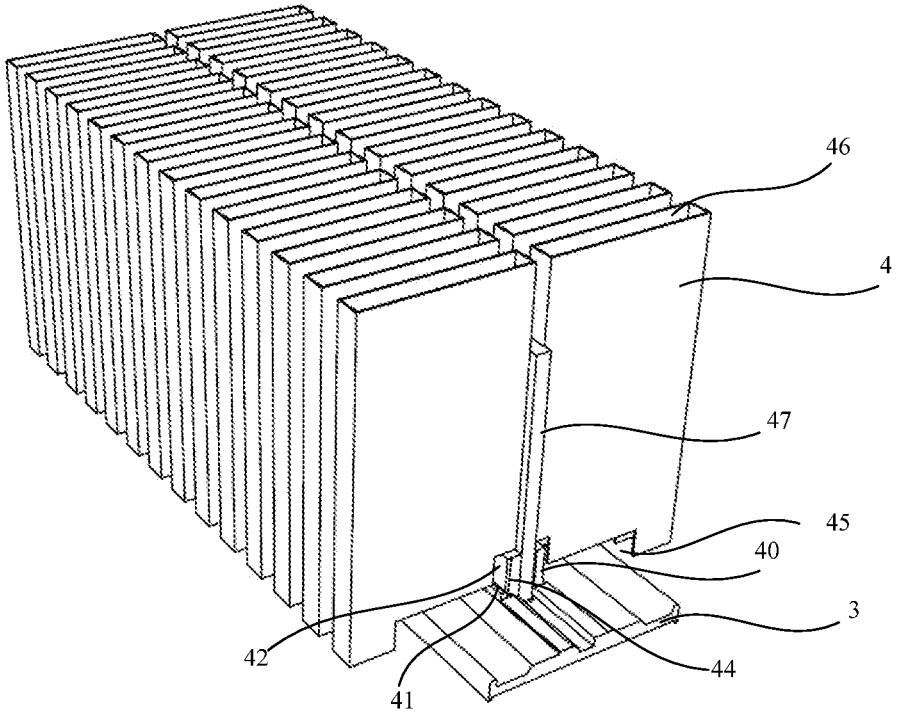
FIG. 22 is a structural schematic view of the heat radiating device for a lighting device of Embodiment 7 in the present invention.

FIG. 22 is a structural schematic view of the heat radiating device for a lighting device of Embodiment 7 in the present invention. The heat radiating device for a lighting device of the present invention can be based on the heat radiation device for a lighting device of Embodiment 5 with the following difference: in the present embodiment, the slablike upstanding plate 47 is perpendicular to the heat radiating base plate 3, the upper surface of the heat radiating base plate 3 is provided with a mounting pit 36, the structure of the heat radiating base plate 3 can be referred to FIG. 18, the mounting pit 36 has a first soldering side surface 37 and an opposite second soldering side surface 38, and an underside surface 39 defining a groove, the bottom portion of the slablike upstanding plate 47 is inserted into the upper surface of the heat radiating base plate 3 via the mounting pit 36. A first siding wall 40 and a second siding wall 41 are perpendicularly disposed on the upper surface of the heat radiating base plate 3, and a side surface of the first siding wall 40 is coplane with the first soldering side surface 37 of the mounting pit 36. The gap the first soldering side surface 37 and a first portion of the slablike upstanding plate 47 that faces or is in contact with the first soldering side surface 37, and a gap between the second soldering side surface 38 and a second portion of the slablike upstanding plate 47 that faces or is in contact with the second soldering side surface 38 are filled with solder. Preferably, the second siding wall 41 comprises a first wedge portion 42 and a second wedge portion 43, a first inclined surface of the first wedge portion 42 corresponds to a second inclined surface of the second wedge portion 43. The first wedge portion 42 is disposed on the upper surface of the heat radiating base plate 3, and the second wedge portion 43 is connected with the first wedge portion 42 by a connection 44 such as c bolt, after the bottom portion of the slablike upstanding plate 47 inserted into the mounting pit 36, the bolt traverses the first inclined surface and the second inclined surface.

Preferably, the heat radiating base plate 3 can be a plate structure of its cross section shaped as a rectangle. If the cross section of the heat radiating base plate 3 is of rectangular, the slablike upstanding plate 47 is perpendicular with the upper surface of the heat radiating base plate 3, and if the upper surface of the heat radiating base plate 3 is not a flat plane and is concave-convex, then the slablike upstanding plate 47 is perpendicular with the rectangular space that the heat radiating base plate 3 occupied. The shape of the mounting pit 36 disposed on the heat radiating base plate 3 corresponds to the shape of the bottom of the slablike upstanding plate 47, and the mounting pit 36 has three surfaces, the first soldering side surface 37, the underside surface 39 and the second soldering side surface 38. The first siding wall 40 is fixed and connected on the top surface of the heat radiating base plate 3, the first wedge portion 42 of the second siding wall 41 is fixed and connected on the top surface of the heat radiating base plate 3, due to the vertical surface of the first siding wall 40 is coplane with the first soldering side surface 37 of the mounting pit 36, during actual installation, the slablike upstanding plate 47 is inserted into the mounting pit 36, the gaps between the slablike upstanding plate 47 and the mounting pit 36 is filled with solder, that is, the gap between the first portion of the slablike upstanding plate 47 and the first soldering side surface 37, and the gap between the second portion of the slablike upstanding plate 47 and the second soldering side surface 38 are filled with solder, the second wedge portion 43 is disposed on the first wedge portion 42, the first inclined surface of the first wedge portion 42 corresponds to the second inclined surface of the second wedge portion 43. Bolt hole is disposed on the first wedge portion 42 and the second wedge portion 43, the second wedge portion 43 is disposed on the first wedge portion 42 by a bolt traverses through both the bolt holes of the first wedge portion 42 and the second wedge portion 43. During the tightening of the bolt, the vertical surface of the second wedge portion 43 abuts the slablike upstanding plate 47 and creates a horizontal force to push the slablike upstanding plate 47 and make the slablike upstanding plate 47 move towards to the first siding wall 40, and the same time extrude the solder between the slablike upstanding plate 47 and the first soldering side surface 37 of the mounting pit 36 and the vertical surface of the first siding wall 40, eliminate the gas in the solder, thus can improve the soldering effect and improve the heat transmitting effect between the heat radiating base plate 3 and the slablike upstanding plate 47.

Embodiment 8 of the Heat Radiation Device of Lighting Device

Figure 23:
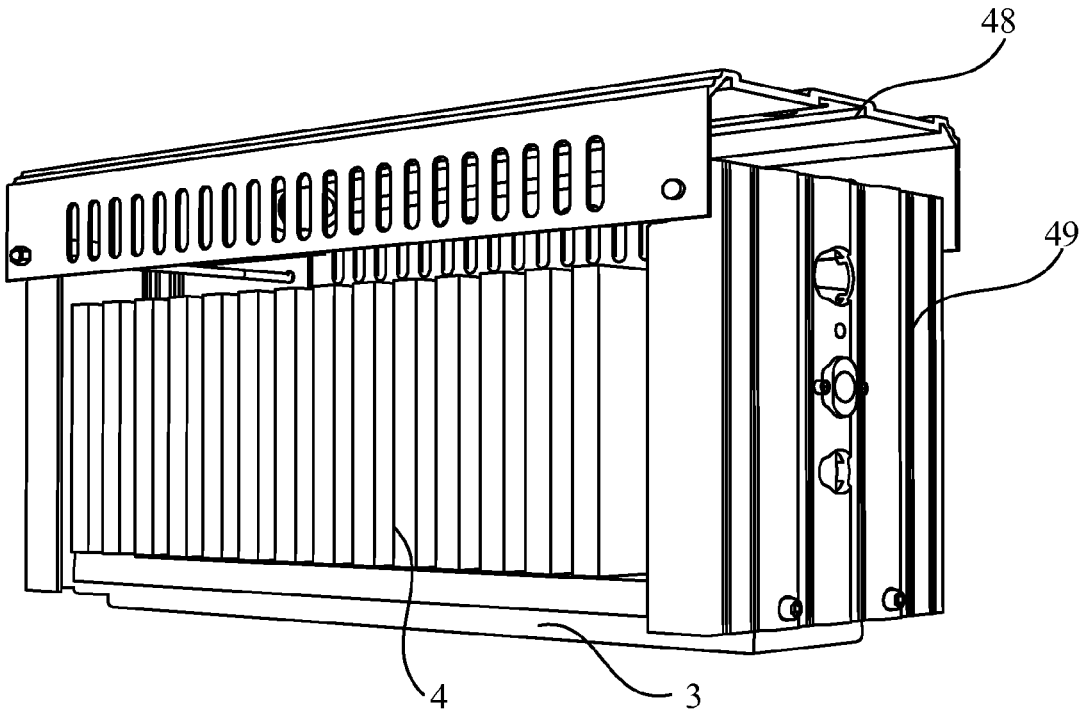
FIG. 23 is a structural schematic view of an implementing mode of the heat radiating device for a lighting device of Embodiment 8 in the present invention.

FIG. 23 is a structural schematic view of an implementing mode of the heat radiating device for a lighting device of Embodiment 8 in the present invention. The heat radiating device for a lighting device of the present invention can be based on the heat radiation device for a lighting device of Embodiment 6 with the following difference: the mounting assembly comprises hanging-wall member 48 and two side-wall members 49. One side of the side-wall member 49 is connected with one side of the heat radiating base plate 3 which is in parallel with the heat radiating fin 4, the other side of the side-wall member 49 which is deviated from the heat radiating base plate 3 is connected with the hanging-wall member 48, the side-wall member 49 is both perpendicular with the hanging-wall member 48 and the heat radiating base plate 3, such that the passive heat radiator is covered by the mounting assembly.

Specifically, the hanging-wall member 48 and the side-wall member 49 are both of a U shape structure, as shown in FIG. 23, let's take the hanging-wall member 48 as an example, the hanging-wall member 48 has a flat portion and two buckling portions, the buckling portion is perpendicular with the flat portion. In order to improve air circulation effect better, multiple air holes are arranged on the buckling portion of the hanging-wall member 48. The buckling portion of the side-wall member 49 can be in bolt connection with the buckling portion of the hanging-wall member 48 and form a U shape structure. The size of the hanging-wall member 48 and the side-wall member 49 can be designed according to the size of the passive heat radiator, such that the mounting assembly can cover the passive heat radiator, preferably to have the hanging-wall member 48 cover the heat radiating fins 4 of the passive heat radiator, and have the bottom of the side-wall member 49 connected with the heat radiating base plate 3 of the passive heat radiator by bolts.

Figure 28:
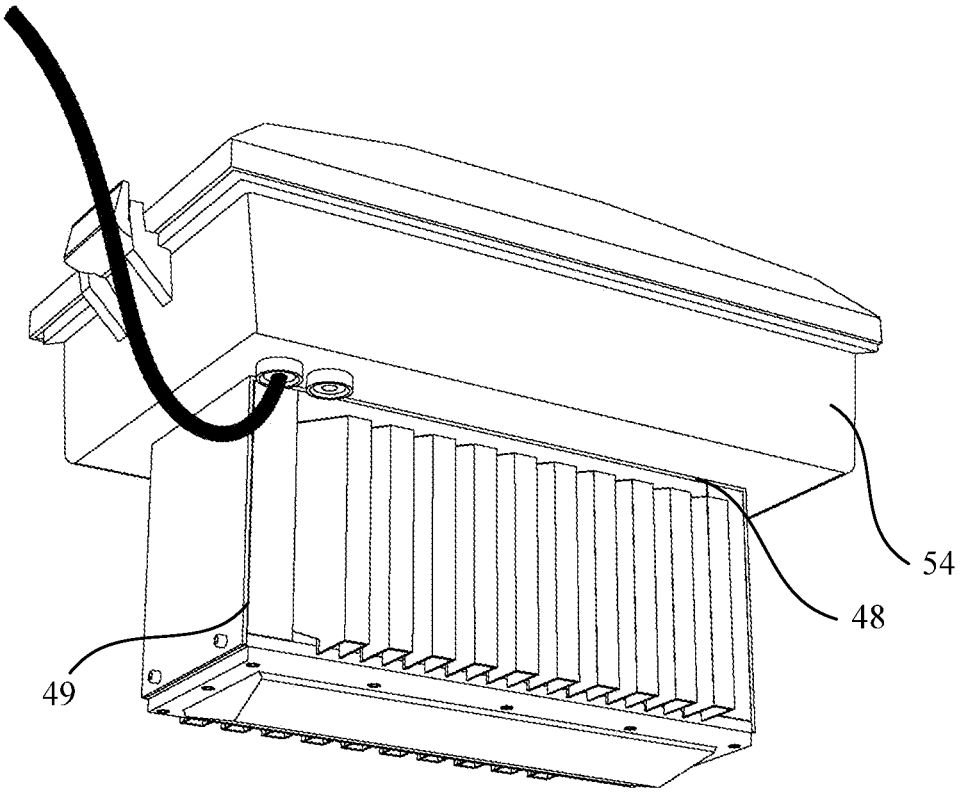
FIG. 28 is a structural schematic view of another implementing mode of the heat radiating device for a lighting device of Embodiment 8 in the present invention.

Mounting holes are arranged on both the hanging-wall member 48 and the side-wall member 49, and can be mounted on the ceiling of the building through the mounting hole, such that the lighting device can be used for indoor illumination. Lamp cap can be fixed and connected on the heat radiating base plate 3, and the lamp cap is fastened on the heat absorb ending face side. The power supply 54 for the lighting device can be arranged on the hanging-wall member 48, as shown in FIG. 28.

Embodiment 9 of the Heat Radiation Device of Lighting Device

Figure 24:
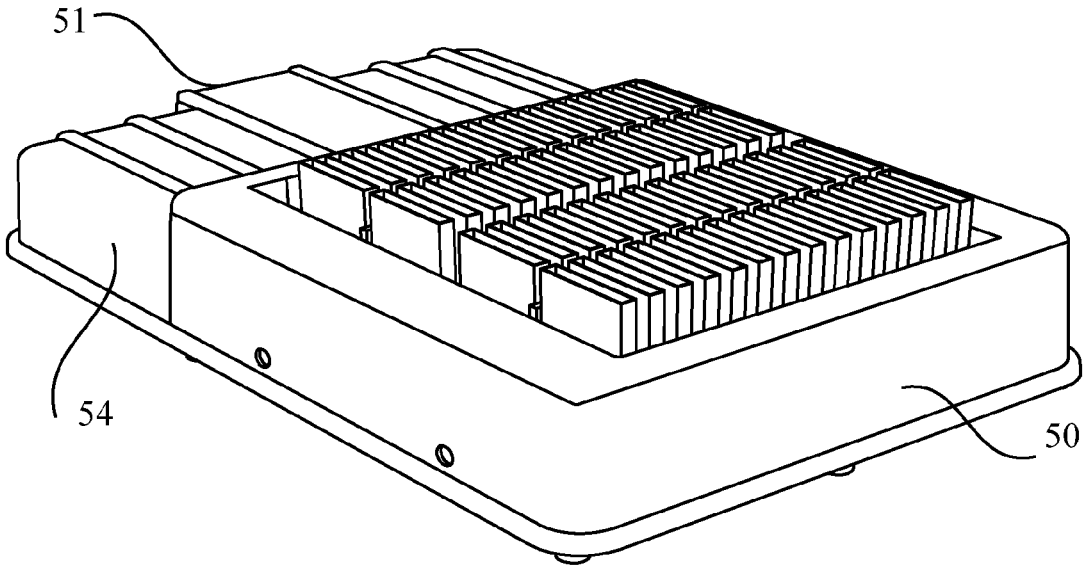
FIG. 24 is a structural schematic view of an implementing mode of the heat radiating device for a lighting device of Embodiment 9 in the present invention.
Figure 25:
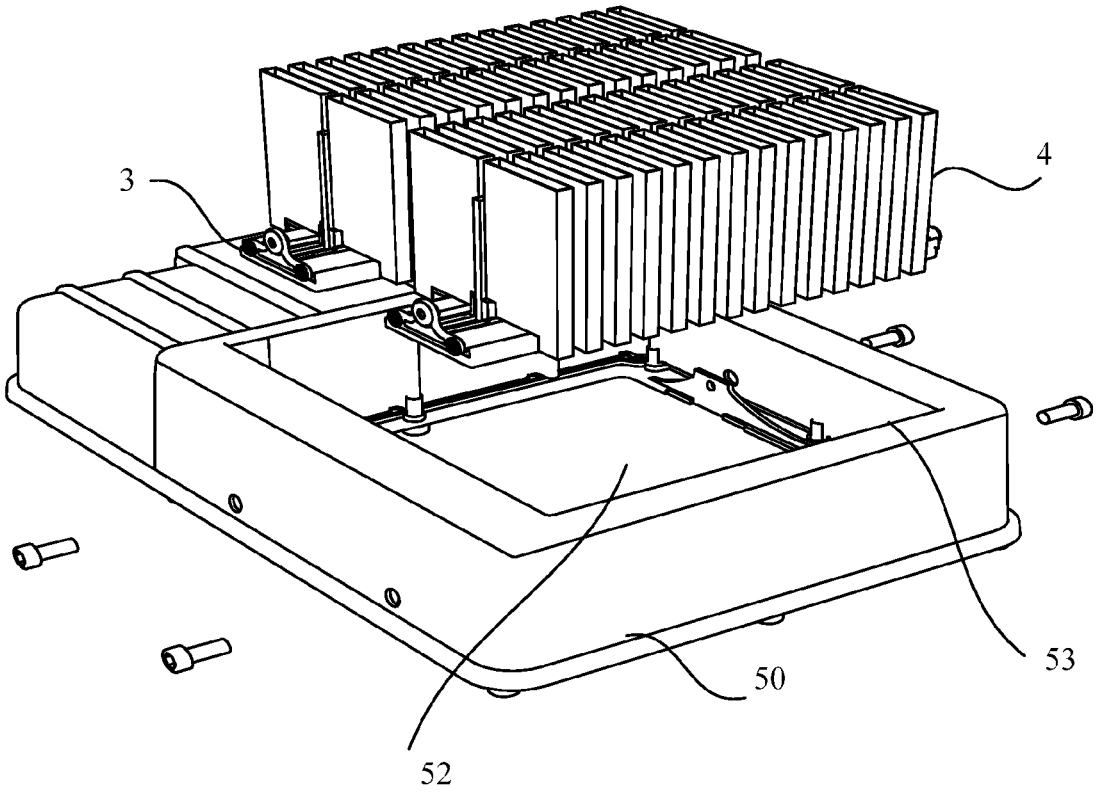
FIG. 25 is the structural schematic view of the explosion of the heat radiation device for a lighting device shown in FIG. 24.

FIG. 24 is a structural schematic view of an implementing mode of the heat radiating device for a lighting device of Embodiment 9 in the present invention, and FIG. 25 is the structural schematic view of the explosion of the heat radiation device for a lighting device shown in FIG. 24. The heat radiating device for a lighting device of Embodiment 9 of the present invention compared with the heat radiation device for a lighting device of above embodiments, having following difference: the mounting assembly comprises a mounting housing 50 and a lamp-post connecting piece 51 for connecting with the lamp-post, the lamp-post connecting piece 51 is disposed on the outer wall of the mounting housing. A mounting opening 52 and an air opening 53 are arranged on the mounting housing 50, the passive heat radiator is disposed in the mounting housing 50 across the mounting opening 52, the heat radiating base plate 3 is connected with the mounting housing 50, the air opening 53 is disposed at the proximal side of the heat radiating fin 4 and away from the heat radiating base plate 3.

Specifically, the mounting opening 52 and the air opening 53 can be disposed on the opposite sides of the mounting housing 50, the mounting housing 50 is arranged with mounting space, the shape of the mounting space can be cubic, and the mounting opening 52 and the air opening 53 is connected through the mounting space. The passive heat radiator is mounted in the mounting space of the mounting housing 50 through the mounting opening 52, and the heat radiating base plate 3 and the side-wall of the mounting housing 50 are fixed and connected by bolt. The lamp-post connecting piece 51 is disposed on the outer wall of the mounting housing 50, preferably disposed on the top of the mounting housing 50. The mounting housing 50 is disposed on the lamp-post of the streetlight by the lamp-post connecting piece 51, such that the lighting device can be used for street lighting. Lamp cap can be fixed and connected on the heat radiating base plate 3, and the lamp cap is fastened on the heat absorb ending face side.

In specific implementation, mounting space for mounting the power supply 54 can be arranged in the mounting housing 50 so as to supply electrical power to the lighting device.

The number of the heat radiator can be single or multiple. Multiple passive heat radiators can be paralleled disposed in the mounting space. In a specific implementation, the width of the mounting space adapts to the length of the passive heat radiator. Therefore, the passive heat radiator is paralleled disposed along the length of the mounting housing 50, as shown in FIG. 24. In another implementation, the length of the mounting space adapts to the length of the passive heat radiator, thus the passive heat radiator is paralleled disposed along the width of the mounting housing 50, as shown in FIG. 26.

Embodiment 10 of the Heat Radiation Device of Lighting Device

Figure 26:
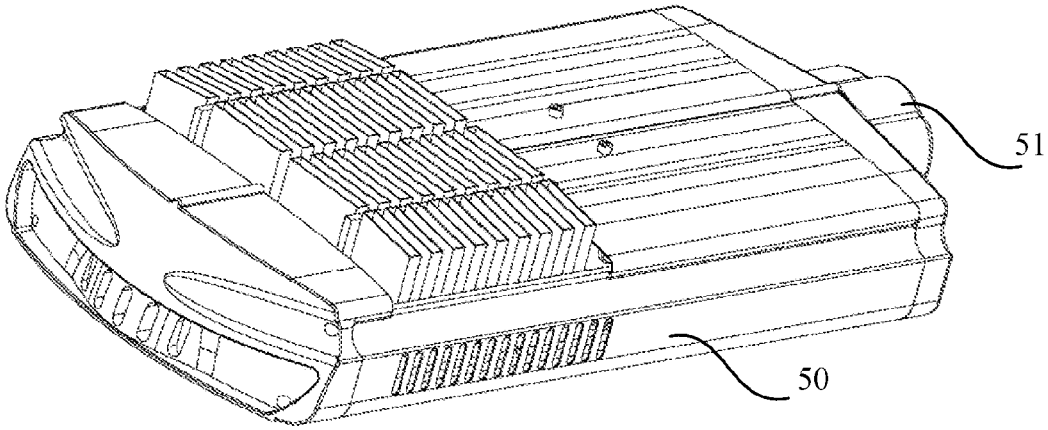
FIG. 26 is a structural schematic view of another implementing mode of the heat radiating device for a lighting device of Embodiment 9 in the present invention.

FIG. 26 is a structural schematic view of the heat radiating device for a lighting device of Embodiment 10 in the present invention. The heat radiating device for a lighting device of Embodiment 10 of the present invention compared with the heat radiation device for a lighting device of above embodiments, having following difference: the mounting assembly comprises two transversal beams 55 and a lamp-post connecting piece 51 for connecting with a lamp-post, the lamp-post connecting piece 51 is connected with the transversal beams 55. The two transversal beams 55 are disposed in parallel. A mounting groove is disposed on the transversal beam 55, the side of the heat radiating base plate 3, which is in parallel with the heat radiating fin 4, is inserted into the mounting groove.

Figure 27:
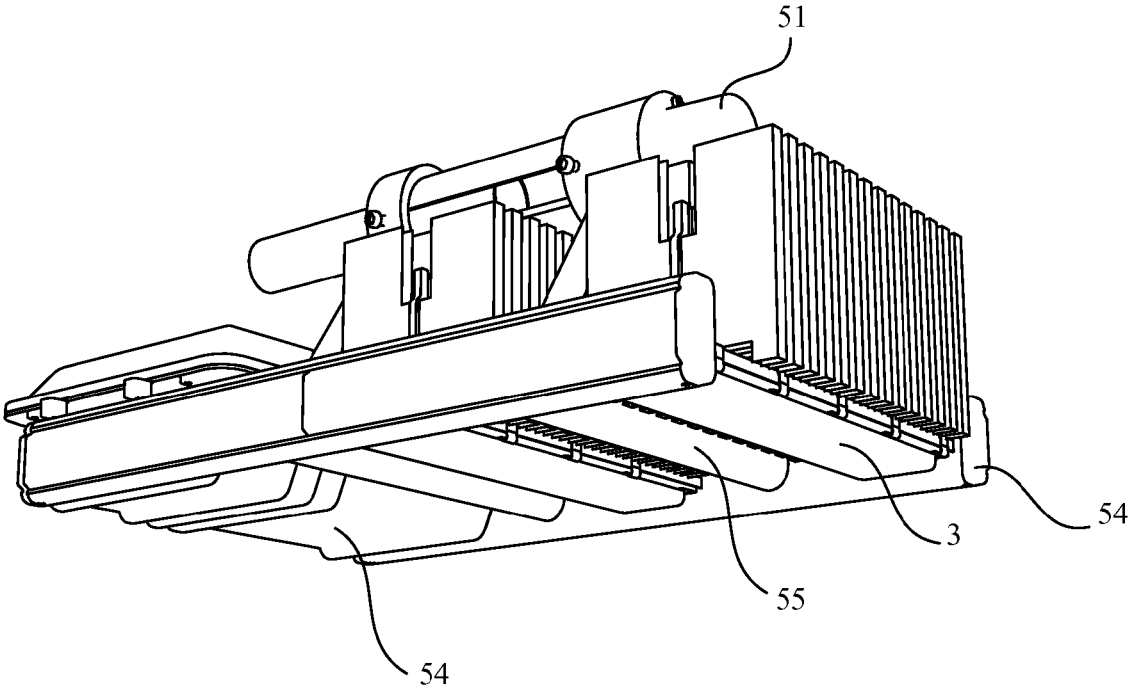
FIG. 27 is a structural schematic view of the heat radiating device for a lighting device of Embodiment 10 in the present invention.

Specifically, in order to improve the stability of the mounting assembly, the mounting assembly can further have a longitudinal beam 56 or multiple longitudinal beams 56, and the longitudinal beam 56 is configured to fix two transversal beams 55, when longitudinal beam 56 is applied, the lamp-post connecting piece 51 can be connected with the longitudinal beam 56, the number of the longitudinal beam 56 can be set according to the actual tensile requirement. The heat radiating base plate 3 of the passive heat radiator is stuck in the mounting groove of the two transversal beams 55, and is fixed by bolts. The number of the passive heat radiator also can be single or multiple, FIG. 27 shows two longitudinal beams 56 and three passive heat radiators, in specific application, the number of the passive heat radiator can be set according to the lighting requirement. It should be noted that, the mounting assemblies shown in FIGS. 23-28 and the passive heat radiator shown in FIG. 3 together can form the heat radiation device of the lighting device.

Finally, it should be understood that the above embodiments are only used to explain, but not to limit the technical solution of the present invention. In despite of the detailed description of the present invention with referring to above preferred embodiments, it should be understood that various modifications, changes or equivalent replacements can be made by those skilled in the art without deviated from the scope of the present invention and covered in the claims of the present invention.

What is claimed is:

1. A heat radiation device for a lighting device, comprising a passive heat radiator and a mounting assembly, wherein:

the passive heat radiator comprises: a heat radiating base plate provided with a heat absorbing ending face, a housing connected to the heat radiating base plate, and heat radiating fins connected to the housing, wherein the heat absorbing ending face is disposed at one side of the heat radiating base plate deviated from the housing, and adapted to mount a luminous chip of the lighting device;

the housing comprises:

a slablike upstanding plate, defining a cavity and connected to the heat radiating base plate, wherein the cavity is under vacuum and is filled with liquid working substance having heat evaporation characteristics;

a wick, disposed in the cavity, and at least a portion of the wick is impregnated with the liquid working substance;

a supporting element, disposed in the cavity, adapted to eliminate deformation due to pressure on the housing generated by external atmosphere and evaporation of the liquid working substance;

a side edge of the heat radiating base plate is connected with the mounting assembly.

2. The heat radiation device for a lighting device according to claim 1, wherein:

the heat absorbing ending face is provided with a bulb holder for mounting the luminous chip, or a circuit board is disposed within the heat absorbing ending face, and the luminous chip is disposed on the heat absorbing ending face and electrically connected with the circuit board.

3. The heat radiation device for a lighting device according to claim 1, wherein the heat radiating fins are parallel with each other and perpendicularly connected to outer surface of the slablike upstanding plate by soldering.

4. The heat radiation device for a lighting device according to claim 1, wherein an upper surface of the heat radiating base plate has two curved portions joining at a top edge extending along a longitudinal axis of the heat radiating base plate, a cross section of the heat radiating base plate perpendicular to the longitudinal axis has an approximate isoscelestriangle shape, a top angle of the isoscelestriangle shape corresponds to the top edge which is connected with a bottom end of the slablike upstanding plate, and a gap for ventilation is formed between the upper surface of heat radiating base plate and the heat radiating fins.

5. The heat radiation device for a lighting device according to claim 1, wherein the housing is connected to the heat radiating base plate by soldering, and in contact with the heat radiating base plate along the entire length of the heat radiating base plate.

6. The heat radiation device for a lighting device according to claim 1, wherein an upper surface of the heat radiating base plate is provided with a mounting pit, a bottom portion of the housing is inserted into the upper surface of the heat radiating base plate via the mounting pit, and the wick is disposed in the bottom portion of the housing adjacent to the heat absorbing ending face.

7. The heat radiation device for a lighting device according to claim 6, wherein the mounting pit is a longitudinal groove extending along an entire length of the heat radiating base plate and dividing the heat radiating base plate into two symmetrical portions, the upper surface of the heat radiating base plate comprises two curved portions symmetrical about the longitudinal groove of the heat radiating base plate, and a space is formed between the curved portions and a bottom of the heat radiating fins defining a tapered channel to enhance the air circulation in channels between the heat radiating fins.

8. The heat radiation device for a lighting device according to claim 6, wherein:

the housing is perpendicular to the heat radiating base plate;

the mounting pit has a first soldering side surface, an opposite second soldering side surface, and an underside surface defining a groove;

a first siding wall and a second siding wall are disposed on the upper surface of the heat radiating base plate;

a side surface of the first siding wall is coplane with the first soldering side surface of the mounting pit;

a gap between the first soldering side surface and a first portion of the housing that faces or is in contact with the first soldering side surface, and a gap between the second soldering side surface and a second portion of the housing that faces or is in contact with the second soldering side surface are filled with solder.

9. The heat radiation device for a lighting device according to claim 8, wherein:

the second siding wall comprises a first wedge portion and a second wedge portion, a first inclined surface of the first wedge portion corresponds to a second inclined surface of the second wedge portion;

the first wedge portion is disposed on the upper surface of the heat radiating base plate, the second wedge portion is connected with the first wedge portion by a connection after the bottom portion of the housing inserted into the mounting pit, the connection traverses the first inclined surface and the second inclined surface.

10. The heat radiation device for a lighting device according to claim 1, wherein the heat absorbing ending face is a lug boss or a notch disposed on a bottom surface of the heat radiating base plate; the mounting assembly comprises at least one mounting seat and at least one connecting seat, the mounting seat is connected with a side of the heat radiating base plate, a side of the mounting seat deviated from the heat radiating base plate is connected to the connecting seat; groove and/or projection concave-convex are disposed at the side of the heat radiating base plate and the side of the mounting seat, respectively, and the heat radiating base plate is insertedly connected to the mounting seat via the groove and/or projection.

11. The heat radiation device for a lighting device according to claim 10, wherein a dummy club is disposed at the side of the heat radiating base plate; a mounting hole is formed at the side of the mounting seat; the dummy club of the heat radiating base plate is embodied into the mounting hole at the side of the mounting seat; two sides of the mounting hole is tightly compression jointed on the outer surface of the dummy club by bolt.

12. The heat radiation device for a lighting device according to claim 10, comprising at least two of the passive heat radiators, wherein the mounting seat is connected between two adjacent passive heat radiators, respectively, and connected between the passive heat radiator and the connecting seat.

13. The heat radiation device for a lighting device according to claim 12, wherein an angle is formed between two adjacent heat radiating base plates.

14. The heat radiation device for a lighting device according to claim 1, wherein:

the heat radiating fins are of hollow cubic tubular structure and perpendicularly disposed on two corresponding surfaces of the housing in two groups;

a first opening is formed at a first end of each of the heat radiating fins proximal to the heat radiating base plate serving as a wind inlet, a second opening is formed at a second end of each of the heat radiating fins far to the heat radiating base plate serving as a wind outlet.

15. The heat radiation device for a lighting device according to claim 1, wherein:

the mounting assembly comprises a hanging-wall member and two side-wall members;

one side of the side-wall member is connected with one side of the heat radiating base plate which side is in parallel with the heat radiating fins, the other side of the side-wall member which is deviated from the heat radiating base plate is connected with the hanging-wall member, the side-wall member is perpendicular to both the hanging-wall member and the heat radiating base plate, such that the passive heat radiator is covered by the mounting assembly.

16. The heat radiation device for a lighting device according to claim 1, wherein:

the mounting assembly comprises a mounting housing and a lamp-post connecting piece for connecting with a lamp-post, the lamp-post connecting piece is disposed on an outer wall of the mounting housing;

a mounting opening and an air opening are arranged on the mounting housing, the passive heat radiator is disposed in the mounting housing across the mounting opening, the heat radiating base plate is connected with the mounting housing, the air opening is disposed at a proximal side of the heat radiating fins and away from the heat radiating base plate.

17. The heat radiation device for a lighting device according to claim 1, wherein:

the mounting assembly comprises two transversal beams and a lamp-post connecting piece for connecting with a lamp-post, the lamp-post connecting piece is connected with the transversal beam;

the two transversal beams are disposed in parallel, mounting groove is disposed on the transversal beam, the side of the heat radiating base plate, which is in parallel with the heat radiating fin, is inserted into the mounting groove.

18. The heat radiation device for a lighting device according to claim 1, wherein the lighting device is LED lighting device.

* * * * *